United States Patent [19]

Eisermann

[11] Patent Number: 5,020,346

[45] Date of Patent: Jun. 4, 1991

[54] PERMUTATION LOCK, PARTICULARLY FOR STORAGE COMPARTMENTS

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 421,467

[22] Filed: Oct. 13, 1989

[51] Int. Cl.[5] ..... E05B 47/00

[52] U.S. Cl. ..... 70/279; 70/285; 70/277; 70/315

[58] Field of Search ..... 70/385, 384, 378, 377, 70/315, 279, 277, 278

[56] References Cited

U.S. PATENT DOCUMENTS

| | | | |
|---|---|---|---|
| 4,570,466 | 2/1986 | Matthews | 70/285 |
| 4,637,237 | 1/1987 | Witkoski | 70/285 |
| 4,870,411 | 9/1989 | LeWiner | 70/278 |

*Primary Examiner*—Robert L. Wolfe

*Attorney, Agent, or Firm*—Martin A. Farber

[57] ABSTRACT

A permutation lock, particularly for storage compartments, has a variable combination such that an opening combination corresponds to a combination to which the lock was set by advancement of the bolt into the locked position. The lock has an emergency opening mechanism which can be activated and deactivated by key actuation. To increase the security value with simple actuation of the permutation lock, the emergency opening mechanism can be deactivated only by means of a reactivation key which can be inserted into a lock cylinder.

16 Claims, 25 Drawing Sheets

FIG. 2
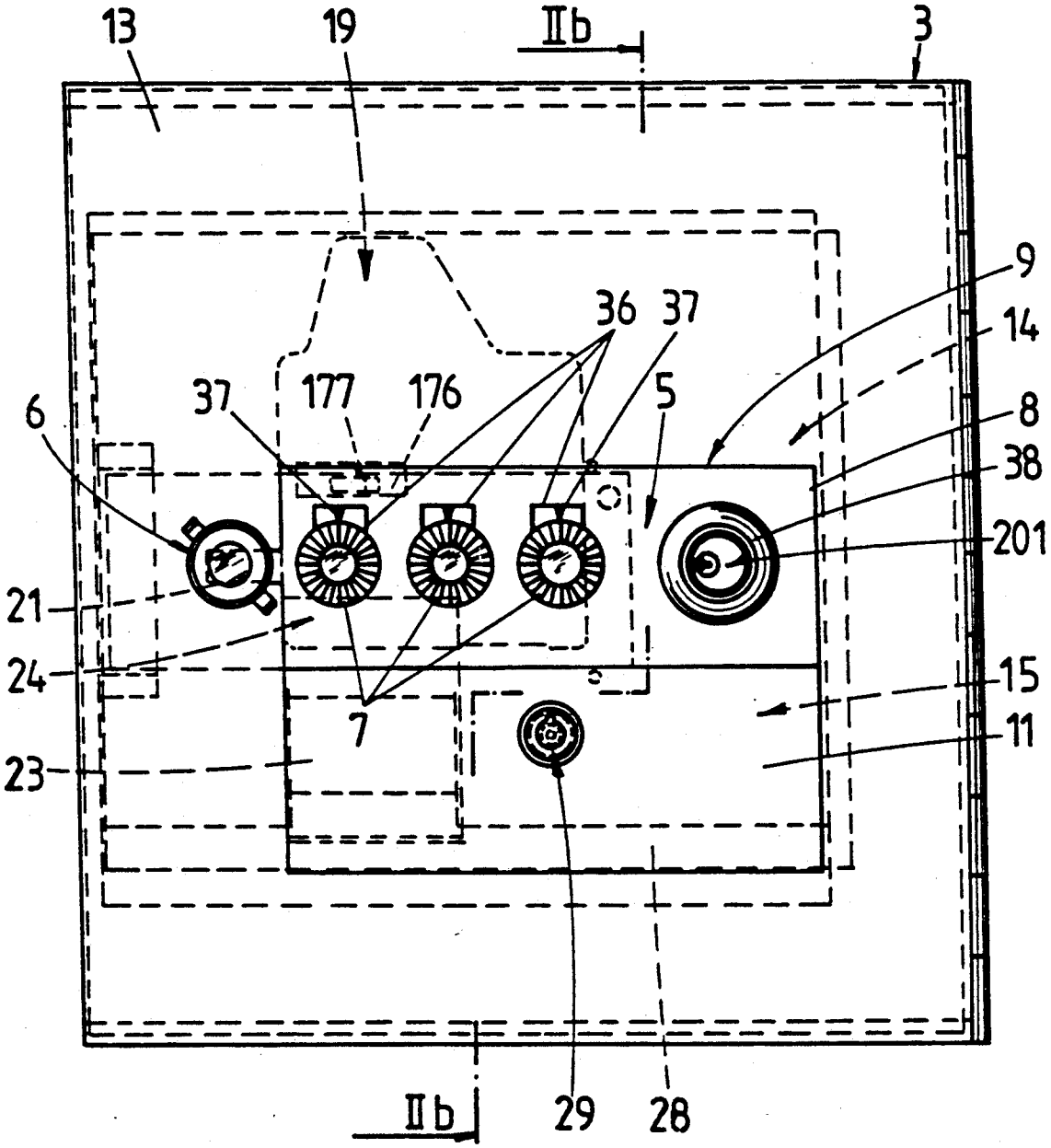
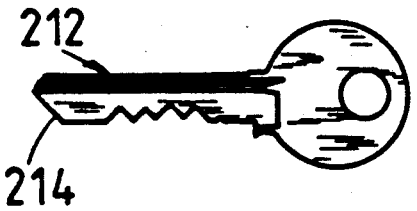
FIG. 3
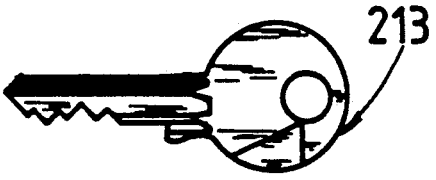
FIG. 4

XV
XIII
200
201
202
203
204
205
206
207
208
209
210
211
212
215
221
222
223
224
12

19
132
133
134
135
145
130
131
146
170
137
136
167
121
125
126
154
155
156
157
164
165
162
158
161
163
159
160
139
141
140
142
138
150
169
149
168
129
127
128
114
153
122
172
152
173
123
117
151
124
120
116
118
119
175
171
115

PERMUTATION LOCK, PARTICULARLY FOR STORAGE COMPARTMENTS

FIELD AND BACKGROUND OF THE INVENTION

The present invention relates to a permutation lock suitable for storage compartments operable with a variable combination.

Such a permutation lock is known from West German Utility Model 86 19 493, in which setting disks bearing symbols must be turned so as to set the key combination. If the bolt is then advanced and the setting disks turned, the opening requires the turning back of the setting disks to the key combination, which permits the retracting of the bolt by means of a handle. It may however happen that the key combination is forgotten if it was not written down. The permutation lock can, nevertheless, be opened, namely by calling in an authorized person, who can be the hotel detective in case the permutation lock is used in hotel rooms. A shield, which is secured by a lockable attachment element and constitutes a part of the emergency opening mechanism, must be removed by the detective.

SUMMARY OF THE INVENTION

It is the object of the present invention so to develop a permutation lock of the foregoing type that, in addition to being of increased security, the emergency opening mechanism can be actuated in simple manner.

This object is achieved in accordance with the invention by providing an emergency opening mechanism which can be deactivated only by means of a reactivation key.

As a result of the invention, there is obtained a permutation lock of the type in question which is characterized by a high value in use. If the user of, for instance, a permutation lock on a hotel-room safe has forgotten the opening combination, he can get in touch with the authorized hotel person. By means of an emergency key, such authorized person will be able to actuate the emergency opening mechanism, which then makes it possible to turn the setting disks to the combination set. The bolt of the permutation lock can then be retracted in customary manner by means of a handle. However, the emergency key does not permit disengagement of the emergency opening mechanism. Therefore, opening the permutation lock with the emergency key leaves traces. Should the emergency key pass in some manner into the wrong hands, then the unauthorized opening of the permutation lock can be noted from the emergency mechanism which has entered into action and which has advantages from an insurance standpoint. The corresponding traces can only be eliminated by using the reactivating key. This key may, for instance, be kept by the hotel manager himself.

The reactiving key makes it possible to disengage the emergency opening mechanism, whereby the permutation lock passes into its initial condition. There is thus present a "four-eyes principle", in the manner that one person is required for the emergency opening and the other for placing the safe in operation, which can take place in succession at longer time intervals than in the case of bank safes. The corresponding control of the emergency opening mechanism with the emergency key and reactivation key can take place in simple manner without requiring extensive assembly work.

The slide, which can be displaced by the emergency key, is an essential component of the emergency opening mechanism. Upon use of the emergency key, this slide is brought into the combination-stop position of the ratchet disks so that, in succession, all rachet disks can be turned by the setting disks into the position which corresponds to the opening code. The reversing of the emergency opening mechanism thereupon requires the reactivation key.

One variant is characterized by the fact that the lock cylinder can be removed by means of the emergency key. In this way the emergency opening mechanism is activated. However, it is then no longer possible to insert the lock cylinder into the mount by means of the emergency key since the reactivation key is required for this. The cylinder core can be turned through only a limited angle of rotation by the emergency key. This angle of rotation is sufficient to remove the lock cylinder from the mounting. As a result of this, the emergency opening mechanism enters into action. However, the coupling of the locking member with the slide can then no longer be effected by the emergency key. Only by means of the reactivation key can the locking member be turned beyond this limited angle of rotation so as to be able to establish the coupling with the slide.

Upon use of the emergency key, a detent of the lock cylinder is moved in simple manner into a release position which permits the subsequent removal of the lock cylinder from the mounting. Simultaneously with the removal of the lock cylinder, the slide enters under spring action into its active position.

A control projection thereby moves into the insertion path of the locking member. Since the latter can be displaced only through a small angle of rotation by means of the emergency key, the locking member cannot act on the latch bevel but comes with its surface against the control projection. Only by using the reactivation key can the locking member be turned into a position in which the locking member brings the slide via the latch bevel, against spring action, into the coupling position.

Basically, the permutation lock is so developed that, when the emergency opening mechanism is active, the secured locking position of the permutation lock cannot be reached. The advanced slide prevents a turning of the ratchet disks. Only a turning of the setting disks is possible. The permutation lock can, in addition, be developed in such a manner that, when the emergency opening mechanism is brought into action, the advance of the bolt is even blocked. This means that the bolt can be moved back out of the locked position of the permutation lock only by means of the emergency opening mechanism but can then no longer be advanced as long as the emergency opening mechanism is in its active position.

This is achieved by relatively simple structural measures which can be carried out economically. For this purpose, the slide must be provided at its end opposite the control projection with an obliquely extending lug which can be produced by cutting it free and bending it upward. If the slide assumes its active position and the bolt is thereupon retracted, the lug acts on the leaf spring attached to the bolt, which leaf spring, in its turn, moves a blocking pin in front of a blocking shoulder on the lock-housing side. Renewed advance is then impossible unless the emergency opening mechanism or the slide is moved back. The blocking pin is able to withstand high stresses due to the fact that it passes through a guide bore in the bolt and is thus given optimal support.

It is advantageous in accordance with one embodiment of the invention if the emergency opening mechanism captures the emergency key and the capture device can be brought into a release position by means of the reactivation key. While, in the one variant, the fact that the lock cylinder was not inserted into the mount, was considered an indication of an opening, the indication in this case is that the emergency key itself cannot be removed. In this connection, such a measure can be taken that the emergency key is blocked in its captured active position against turning backward. The slide then also remains in its active position.

In order to prevent the removal of the emergency key, the capture device has a blocking slide which can be controlled by the reactivation key of the additional lock. In the position carried along by the emergency key, the blocking slide places itself in front of the key insertion opening and remains there. A retracting of the blocking slide.,.can then be carried out only by the reactivation key.

A corresponding additional lock can be accessible both from the inside of the door and the outside of the door of the storage compartment. If it is located on the inner side of the door, then the additional lock cannot be actuated from the outside, so that unintentional displacement of the blocking slide, which would not permit the insertion of the emergency key, is eliminated. However, if the emergency key is to be blocked in its captured active position, the solution should be chosen in which a pawl is used which can be brought into the release position by means of the additional lock actuated by the reactivation key. The pawl is developed in such a manner that, upon displacement of the emergency key, the pawl gives way in the manner of a latch and engages behind the emergency key while blocking the turning backward thereof. In order to effect such a backward turning, the reactivation key must first be inserted so as to bring the pawl into the release position by means of the reactivation key.

BRIEF DESCRIPTION OF THE DRAWING

The invention is illustrated in the drawings with reference to several embodiments. In the drawings:

FIG. 2 is a front view of the safe door;

FIG. 3 is a view of the emergency key;

FIG. 4 is a view of the reactivation key;

DETAILED DESCRIPTION OF THE PREFERRED EMBODIMENTS

Figure 1:
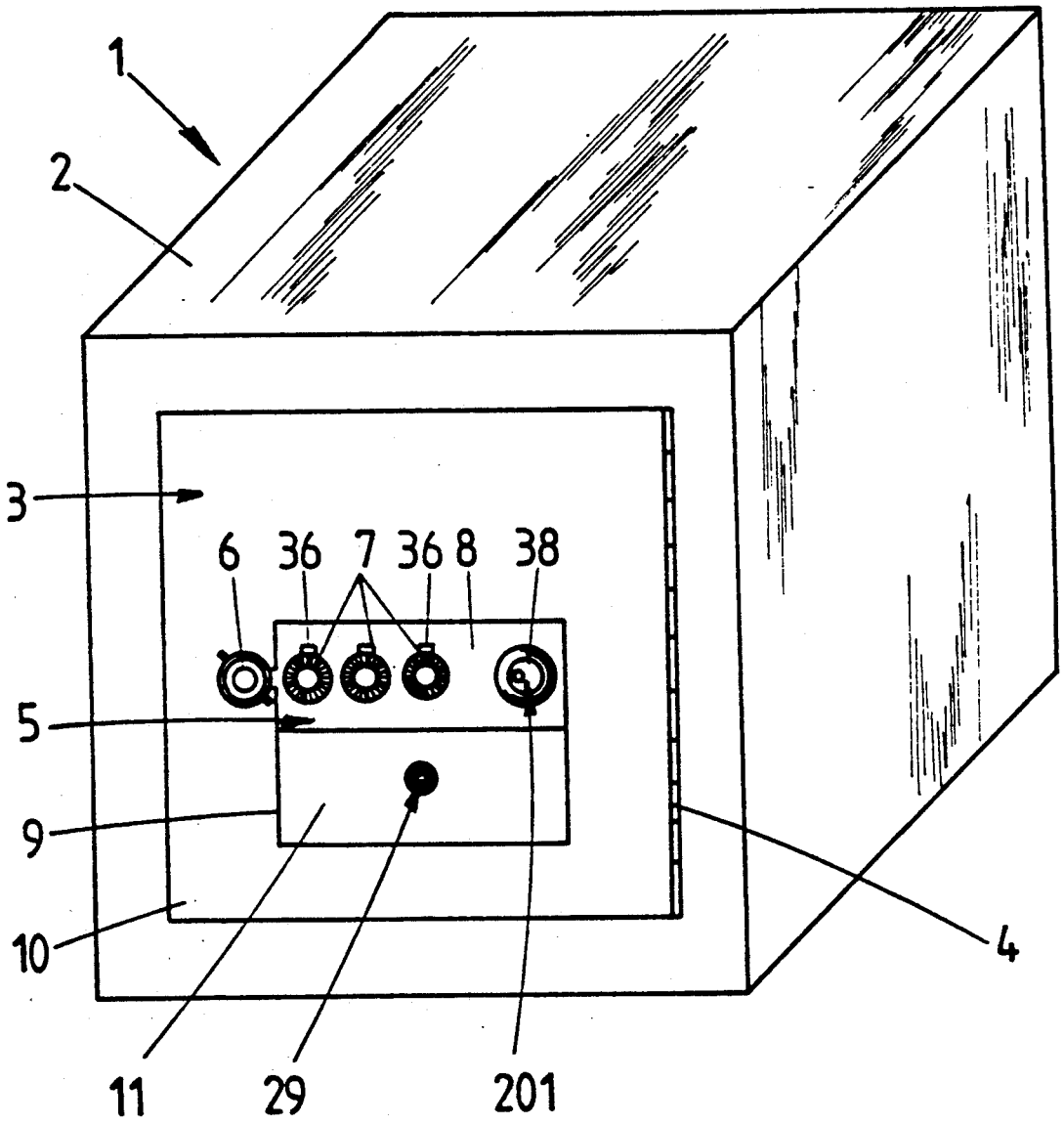
FIG. 1 is a perspective view of a storage compartment developed as hotel room safe.

In accordance with FIG. 1, the storage compartment is a hotel room safe 1 having an armored housing 2 which is closed by a safe door 3 securing the safe space. A permutation lock 5 is arranged on the safe door 3 which, in accordance with FIG. 1, is attached on the right side by means of a hinge 4, the permutation lock having an actuating handle 6 and three setting knobs 7. The permutation lock 5 is covered by a shield 8 which is arranged in the upper region of a window 9 of the outer wall 10 of the safe door 3.

Below the shield 8 there is a cover 11 which fills the lower part of the window 9. Shield 8 and cover 11 are aligned with the outer wall 10 of the safe door 3. In accordance with FIG. 2*b*, the safe door 3 is for the greater part developed double-walled with the creation of an inner wall 12 and an outer wall 13 whereby a permutation-lock receiving chamber 14 and, below same, a coin collection chamber 15 are created. The permutation-lock receiving chamber 14 receives the permutation lock 5, it being supported on the inner side 16 of the outer wall 13 and on the inner side 17 of the inner wall 12. A coin lock 19 is attached to the outer side 18 of the inner wall 12. A recess 21, which is open toward the window 9, passes through the outer wall 10 of the safe door 3, a shaft 22 of the permutation lock 5, which shaft is connected to the actuation handle 6, passing through said recess 21. In accordance with FIG. 2, a connecting coin chute 23 passes through the inner wall 12 of the safe door 3, said chute opening on one side into the coin collection chamber 15 and extending on the other side up to the coin lock 19, and being connected to a coin drop chute 24 of the coin lock 19.

Figure 2B:
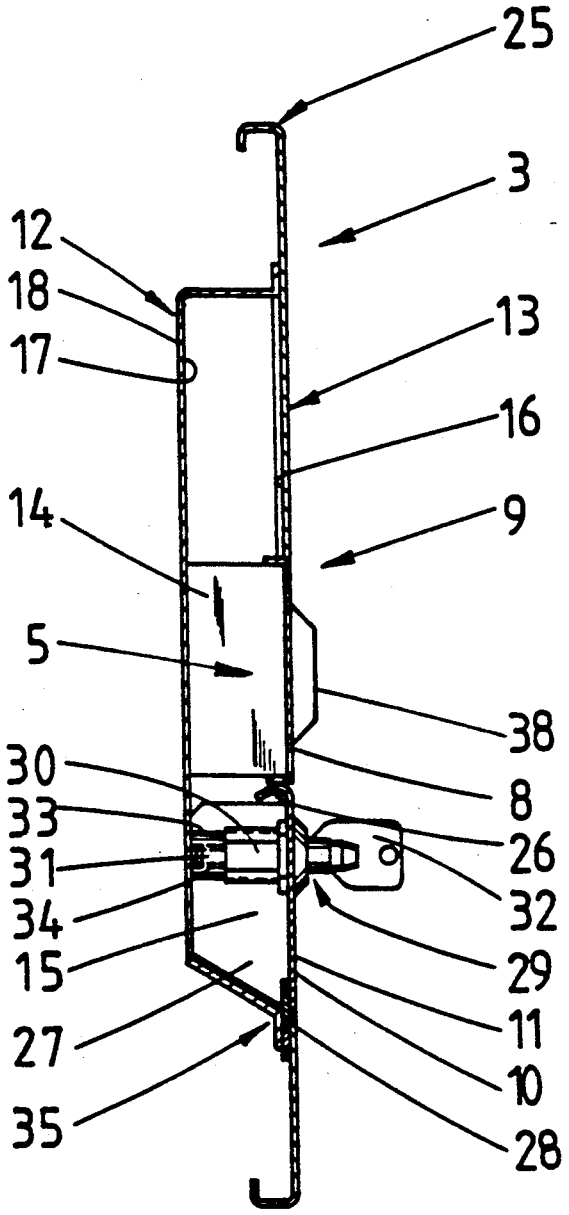
FIG. 2*b* is a section along the line II*b*–II*b* of FIG. 2.
Figure 5:
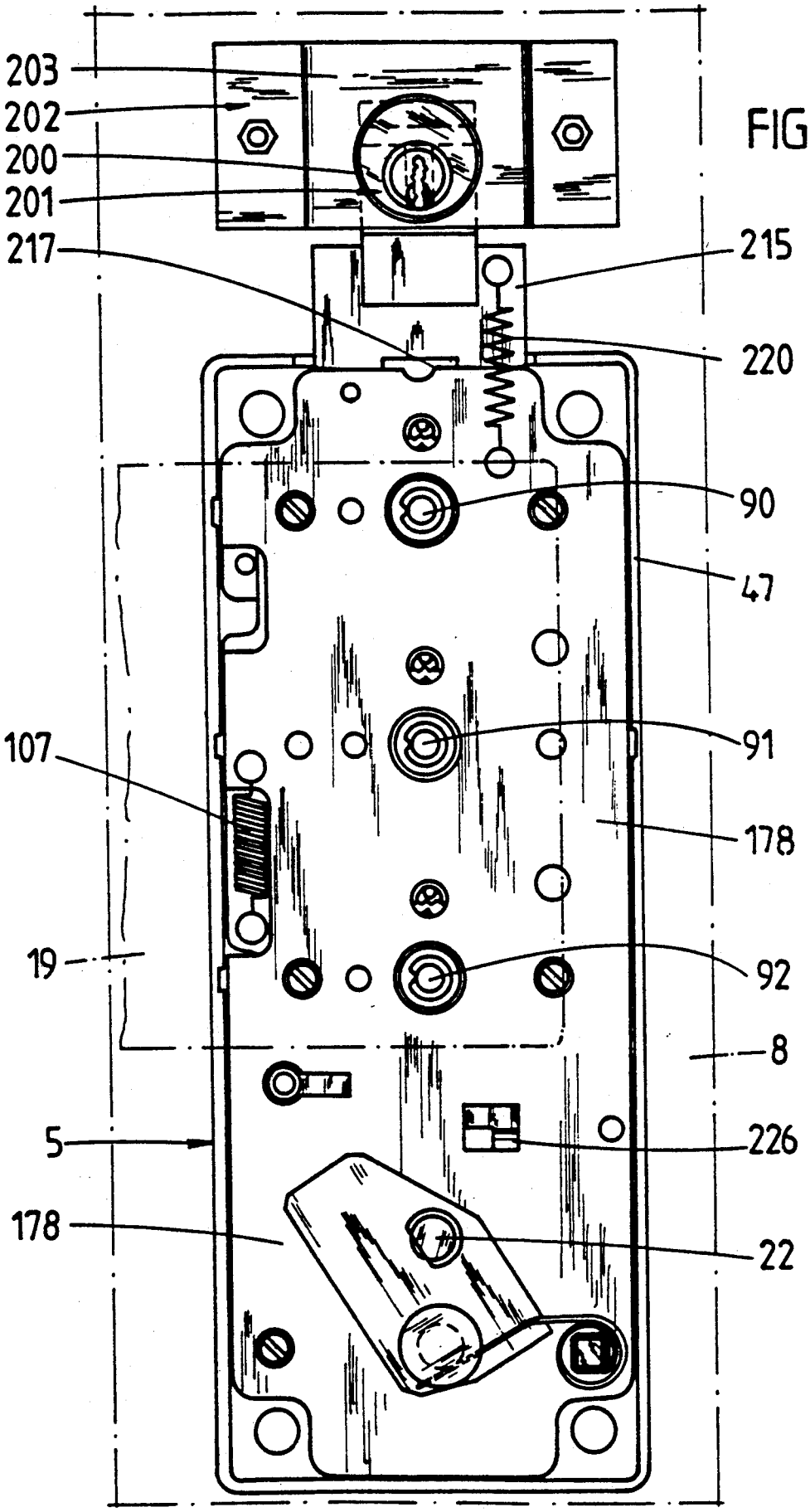
FIG. 5 is a view of the permutation lock with the lock cylinder associated therewith, seen from the lock cover.

In accordance with FIG. 2*b*, the outer edge 25 of the safe door 3 is bent inward in the manner of a collar. The cover 11 has an upper, bent-over edge 26 and supporting plates 27 bent off on both sides. Furthermore, an insertion tongue 28 is attached on the inner side of the lower edge of the cover 11. The cover 11 is provided with an attachment element 29 which can be locked from the outside and is developed as a threaded bolt 31 which is secured against turning by a lock 30. A key 32 can be inserted into the lock 30 whereby the securing against turning of the threaded bolt 31 is eliminated. Upon turning of the key 32, the threaded bolt 31 is carried along. When the cover 11 is in its position corresponding to FIG. 2*b*, i.e., inserted into the window 9, the threaded bolt 31 is aligned with a bushing 33 attached on the inner side 17 of the inner wall 12, the bushing having an axial threaded bore 34. The threaded bolt 31 can be screwed into said bore. In this manner the cover 11 is attached to the safe door 3 so that removal of the cover 11 is not possible when the key 32 has been removed. In order to achieve a firm seat of the cover 11 on the safe door 3, a slot 35 is developed between outer wall 13 and inner wall 12, into which slot the insertion tongue 28 of the cover 11 is inserted on insertion of the cover. Furthermore, the cover 11 is supported with its two lateral supporting plates 27 on the inner side 17 of the inner wall 12.

The shield 8 which covers the permutation lock 5, has three openings 36 which are aligned with the setting knobs 7 of the permutation lock 5 and are developed as keyholes and reveal markings 37 in the upper region. In accordance with FIG. 2, the shield 8 has on its right side a bezel 38 into which a mount 200 of tubular cross section for a lock cylinder 201 engages. The free end of the lock cylinder 201 terminates flush with the collar 38. The opposite end of the mount 200 is seated on a support 202 of U-shaped cross section which is attached to the inner wall 12 of the safe door 3. As a result of the U shape, a free space is formed between the inner wall 12 and the web 203 of the support 202, the locking member 205 which is formed on the end of the cylinder core 204 extending into said free space. The locking member 205 is produced by flats on both sides which extend parallel to each other.

The locking member 205 of the cylinder core 204 extends beyond the lock cylinder 201, which is supported on the bottom 206 of the mount 200 which is closed on one side. A rotation-preventing pin 207 protruding from the facing end surface of the lock cylinder 201 secures the lock cylinder or its housing 208 against twisting within the mount 200.

In order to enable the locking member 205 to pass through the web 203 and the bottom 206, openings 209 which are aligned with each other are provided in both of them.

In order to secure the position of the installed lock cylinder 201 in axial direction, a segment-shaped blocking segment 210 is provided which forms a detent, is adjacent to the bottom 206 and engages, under spring action, into a radial recess 211 of the mount 200.

The lock cylinder 201 can be locked by means of both an emergency key 212 and a reactivation key 213. The emergency key 212 corresponds substantially to the reactivation key 213 and differs from the latter by a longer key shank end 214. This lengthened key shank end 214 makes it possible, after insertion of the emergency key 212 into the cylinder core 204, to displace the cylinder core by a limited angle of rotation, accompanied by a control of the blocking segment 210 in the manner that the latter leaves the radial recess 211 of the mount 200. The lock cylinder 201 can then be pulled out of the mount 200 by means of the emergency key 212. The reactivation key 213, after its insertion into the cylinder core, does not pass into the region of the blocking segment 210. In this way, the cylinder core can be turned through a larger angle of rotation than when using the emergency key 212. The shield 8 is attached to the safe door 3 by means of a plug-in and turn connection. A fastening screw which is screwed in from the inner side of the door serves for the attachment.

The permutation lock 5 has a lock case 47 with pairs of guide pins 48, 49 and 50 which are integral with it and protrude from it. Threaded holes are provided in the guide pins in order to be able to attach a lock case cover 178 inserted into the lock case 47. Support pins which protrude from the lock bottom 109 and have not been shown in detail serve as guide mandrels for shaft 22 of the actuating handle 6 and the setting knobs 7. Both the support pins and the pairs of guide pins 48–50 form a guide for bolt 51 which is mounted in the lock case 47, the bolt resting with its edges against the pairs of guide pins 48–50 and having slots through which the said support pins pass. The bolt 51 is moveable along the double arrow 52 and has on its end a bolt head 53 which cooperates with a lock plate (not shown) of the frame of the safe door.

From the top side 54 of the bolt slide 51 there extend three blocking projections, not shown in detail, which can engage into radial slots of rotatable ratchet disks 55, 56 and 57. Three further blocking pins 58, 59 and 60 cooperate tumblers 61, 62 and 63 associated with them. The shaft 22 which is attached to the actuating handle 6, has an arm 64 which bears on its end a pin 65 which engages into a hole 66 in the bolt 51. By turning the actuating handle 6, the bolt 51 can thus be displaced via the arm 64 and the pin-hole connection. Each ratchet disk 55, 56 and 57 has on its bottom side the above-described radial slot into which the above-mentioned blocking pins engage whenever the bolt 51 is retracted. This engagement, however, is only brought about when the ratchet disks 55, 56, 57 are in proper angle-of-rotation position so that the slots are aligned with the blocking pins. This position corresponds to the preselectable combination of the permutation lock. If merely one ratchet disk is turned with respect to the above-mentioned position, then the associated blocking pin cannot enter into the corresponding slot, so that the bolt 51 cannot be moved out of its locking position into the unlocking position.

The ratchet disks 55, 56, 57 bear on their top sides diametrically extending grooves 67, 68, 69, which receive diametral webs 70, 71, 72. At one end, these diametral webs 70, 71, 72 bear locking teeth 73, 74, 75.

Furthermore, the permutation lock 5 has a common reversing slide 76 which has three circular recesses 77, 78, 79. The diameter of the recesses 77, 78, 79 corresponds to that of the ratchet disk 55, 56, 57. The reversing slide 76, which is also guided displaceably in the direction of its longitudinal extension in the lock case 47, is, however, arranged in such a manner above the ratchet disks 55, 56, 57 that upon displacement it merely carries along the diametral webs 70, 71, 72. The displacement of the reversing slide 76 takes place by means of a control lever 80 which grips around the arm 64 and is swingable around a pin 81 of the lock case 47. On the top side of the reversing slide 76, there is developed a control pin 82 which engages into a slot 83 of the control lever 80. If the actuating handle 6 is now turned and the arm 64 thus swung, then the control lever 80 is also swung, whereby the reversing slide 76 is moved via the control pin 82 and the slot 83.

The tumblers 61, 62, 63 have pairs of slots 84, 85, 86 by which they can be displaced on the pairs of guide pins 48, 49, 50 in a direction transverse to the longitudinal direction of the bolt 51. Each tumbler 61, 62, 63 has an oval recess 87, 88, 89. On the supporting pins (not shown in detail) there are mounted shafts 90, 91, 92 which are hollow at one end and bear the setting knobs 7 at their other end. The shafts 90, 91, 92 are connected, fixed for rotation, with toothed disks 93, 94, 95, the parts being so adapted to each other in height that the toothing of the toothed disks 93, 94, 95 can mesh both with the locking teeth 73, 74, 75 and with the detent teeth 96, 97, 98 of the tumblers 61, 62, 63. The tumblers 61, 62, 63 are held in engagement with the toothed disks 93, 94, 95 by compression springs 99, 100, 101.

The reversing slide 76 is urged by a tension spring 107 in the direction of the arrow 108.

A slide 215 is guided between the reversing slide 76 and the tumblers 61, 62, 63. The slide 215 has, in the region of the ratchet disks 55-57, three slot-like radial recesses 216 into which the diametral webs 70–72 extend at one end, namely with their ends which are thickened in the form of locking teeth 73, 74, 75. For the engagement of the corresponding ends, niches 217, 218, 219 of different depths extend from the radial recesses in the longitudinal direction of the slide for the form-locked entrance of the ends of the diametral webs. A tension spring 220 acts on the slide 215, the tension spring urging the slide 215 in the direction of the bolt head 53.

Figures 12, 13, 14:
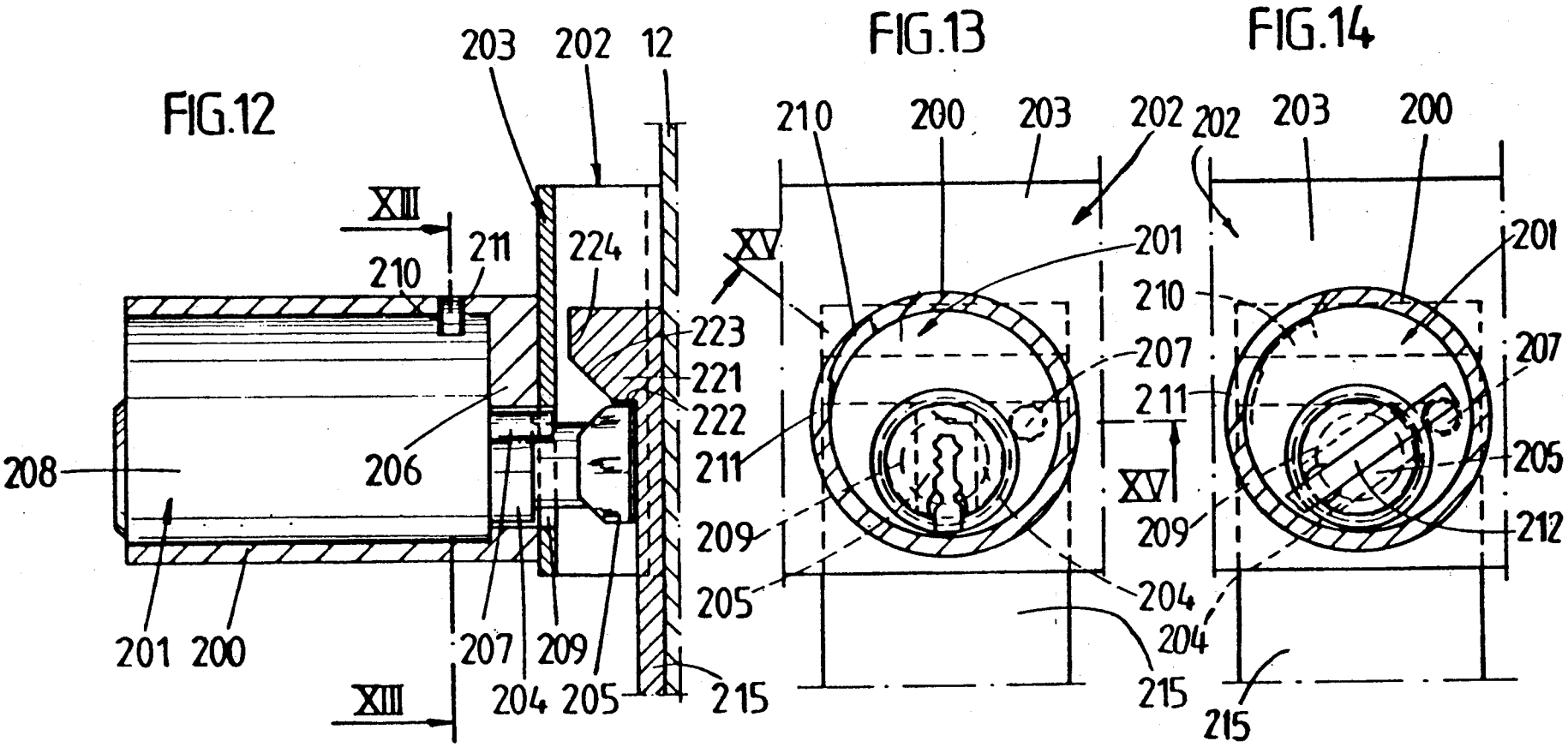
FIG. 12 is a section along the line XII—XII of FIG. 8.
FIG. 13 is a section of the lock cylinder along the line XIII—XIII, shown in front view.
FIG. 14 is a view corresponding to FIG. 13 but with the emergency key inserted and turned.

A control projection 221 is formed on the end of the slide 215 facing the lock cylinder 201, the control projection extending into the free space between the web 203 and the inner wall 12 and being supported there on the locking member 205; see FIG. 12. For the supporting of the slide 215, the control projection 221 forms a step 222 which continues into a latch bevel 223 which extends obliquely to the direction of movement of the slide. A supporting surface 224 which extends parallel to the front surface of the locking member 205 adjoins the other end of the latch surface.

At its end opposite the control projection 221, the slide 215 forms a lug 226 which is directed obliquely upward in the direction of the lock cover 178. The bolt 51 bears, in the path of movement of the lug 226, a leaf spring 227 which extends in unlocking direction. At its rear end the leaf spring receives a blocking pin 228 which engages into a guide bore 229 of the bolt 51. The end 230 of the leaf spring 227 which faces the lug 226 is bent and is opposite the lug 226. A housing-side blocking shoulder 231 is associated with the blocking pin 228.

Figure 30:
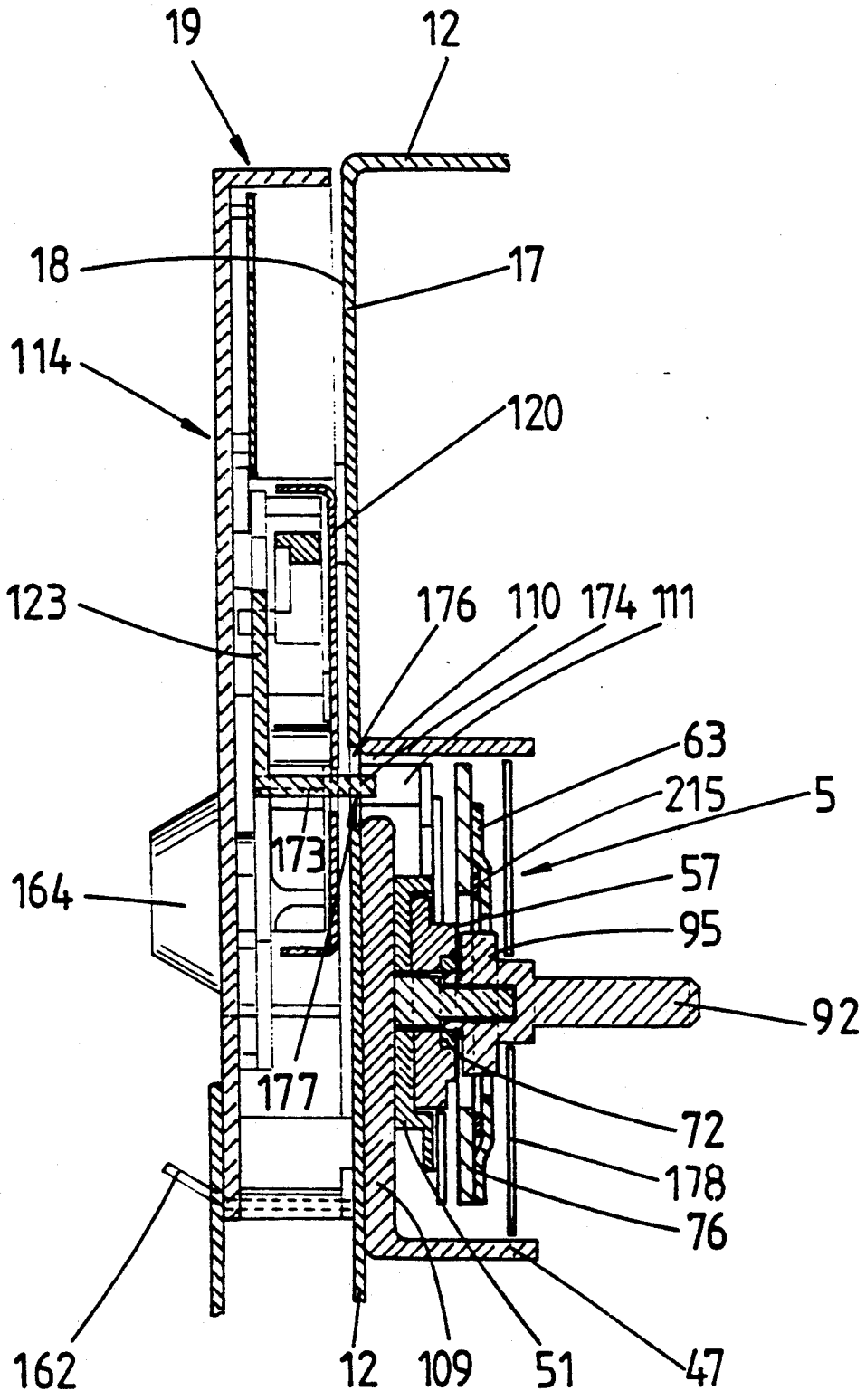
FIG. 30 is a sectional view of a region of the safe door from which the back-to-back arrangement of permutation lock and coin lock can be noted.

It can be noted from FIG. 30 that the bottom wall 109 of the lock case 47 has an opening 110 into which an extension 111 of the bolt 51 is engaged. The extension 111 is thus carried along upon displacement of the bolt 51 in the longitudinal direction of the bolt 51.

Figure 6:
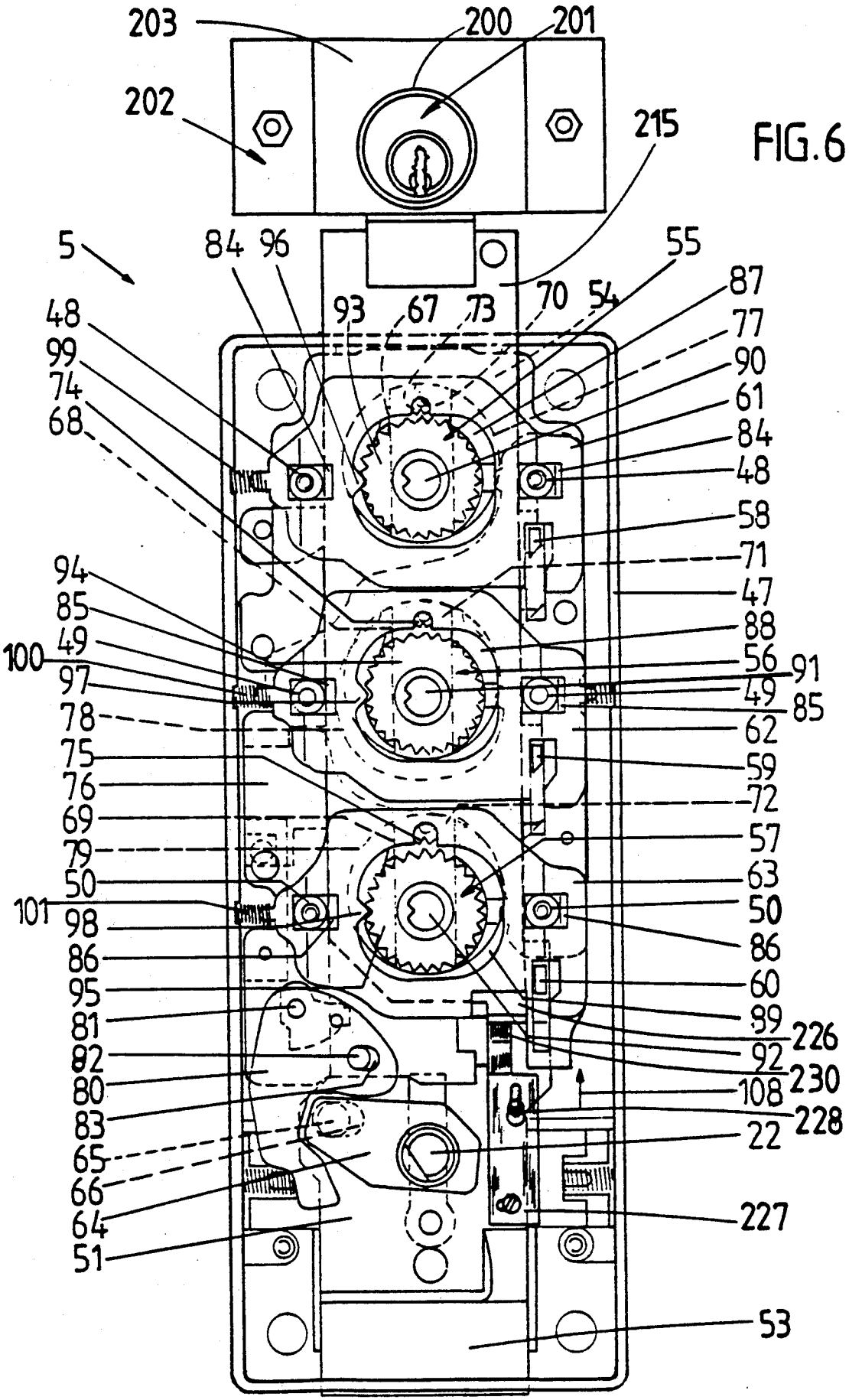
FIG. 6 is a plan view of the opened permutation lock, the bolt being in the open position.
Figure 7:
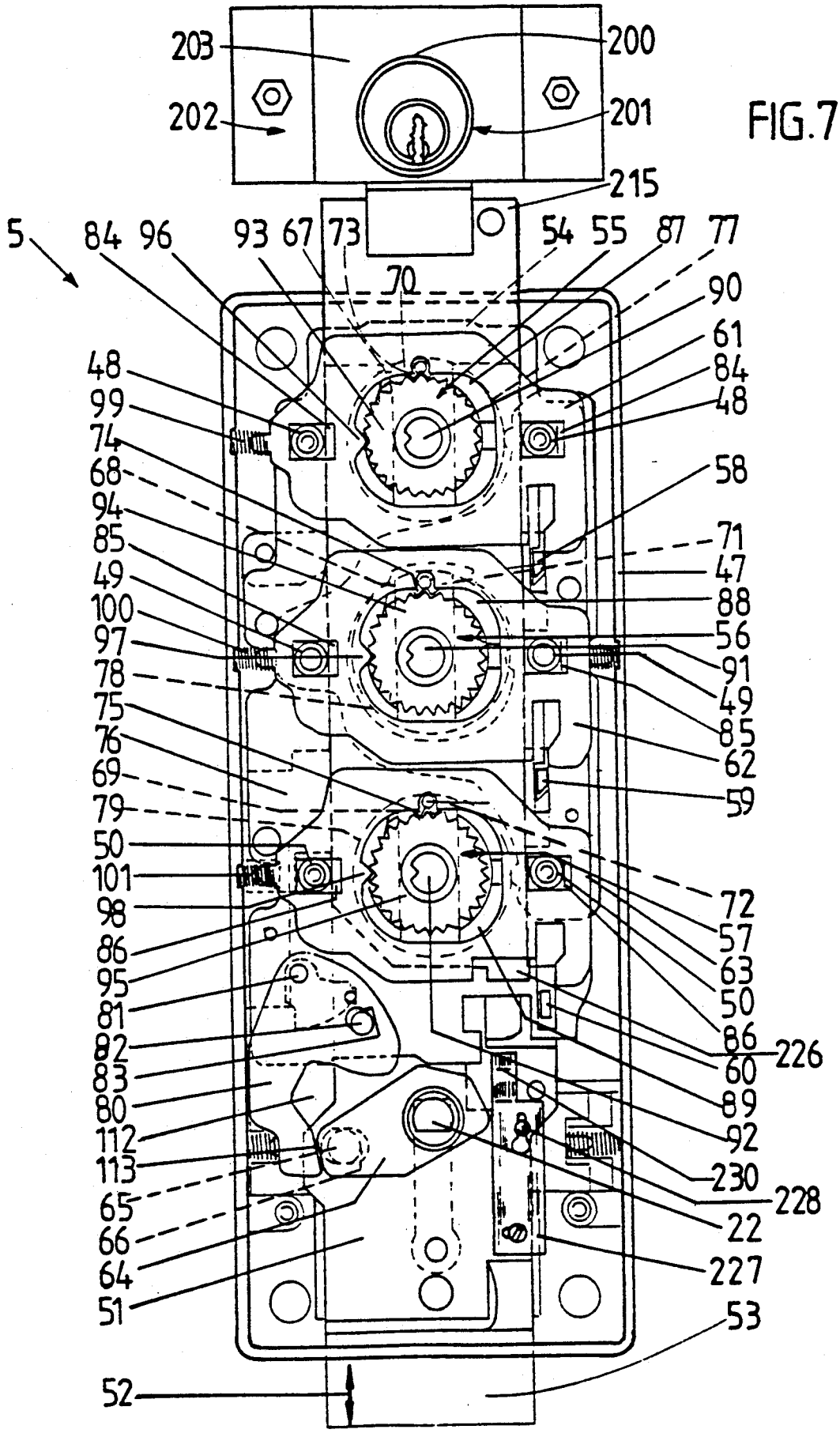
FIG. 7 is a plan view of the permutation lock of FIG. 6, but with the bolt in advanced position.
Figure 8:
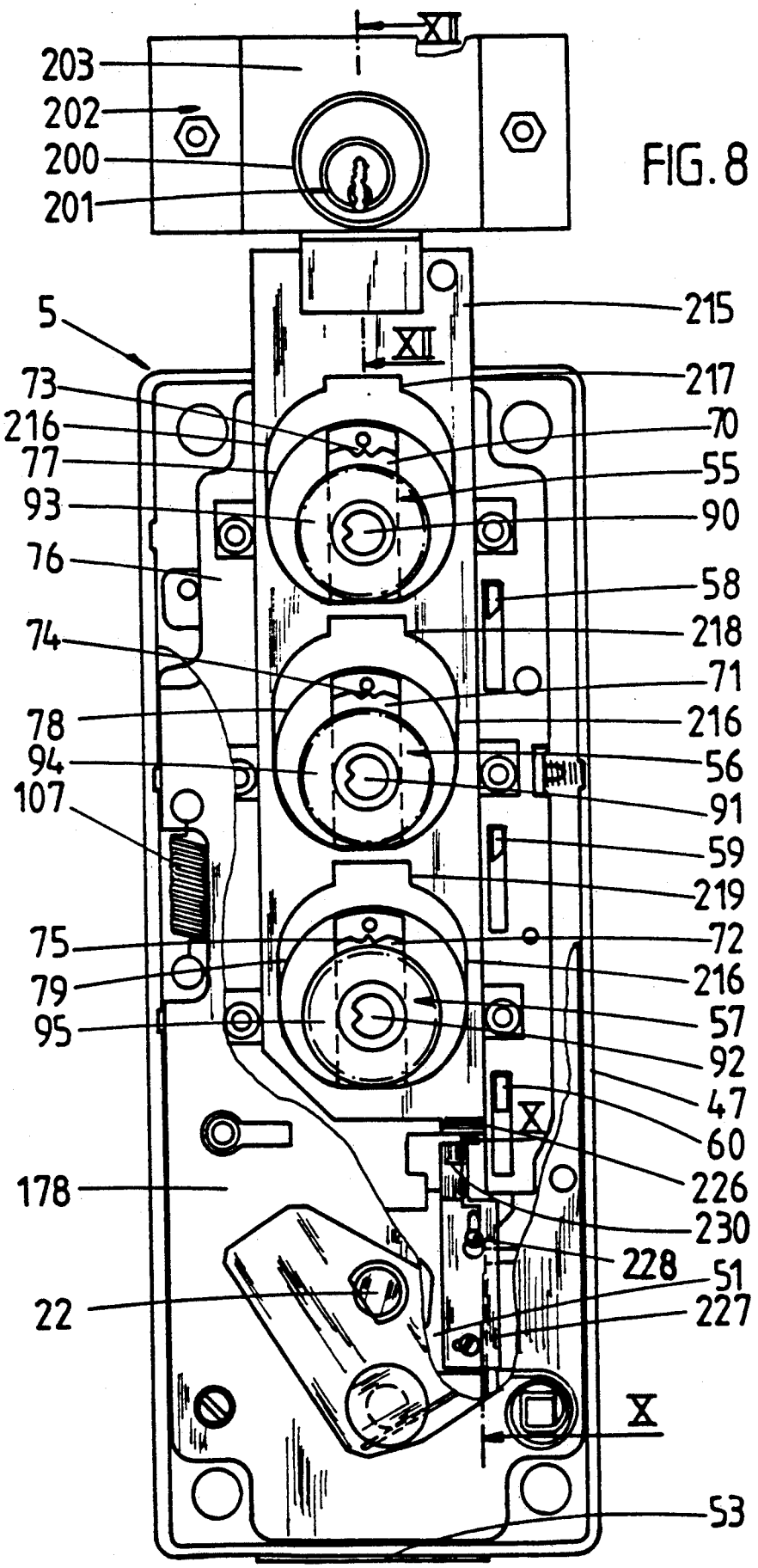
FIG. 8 is also a rear view of the permutation lock, with the lock cover partially broken away and lock parts having been omitted so as to show the slide.
Figure 9:
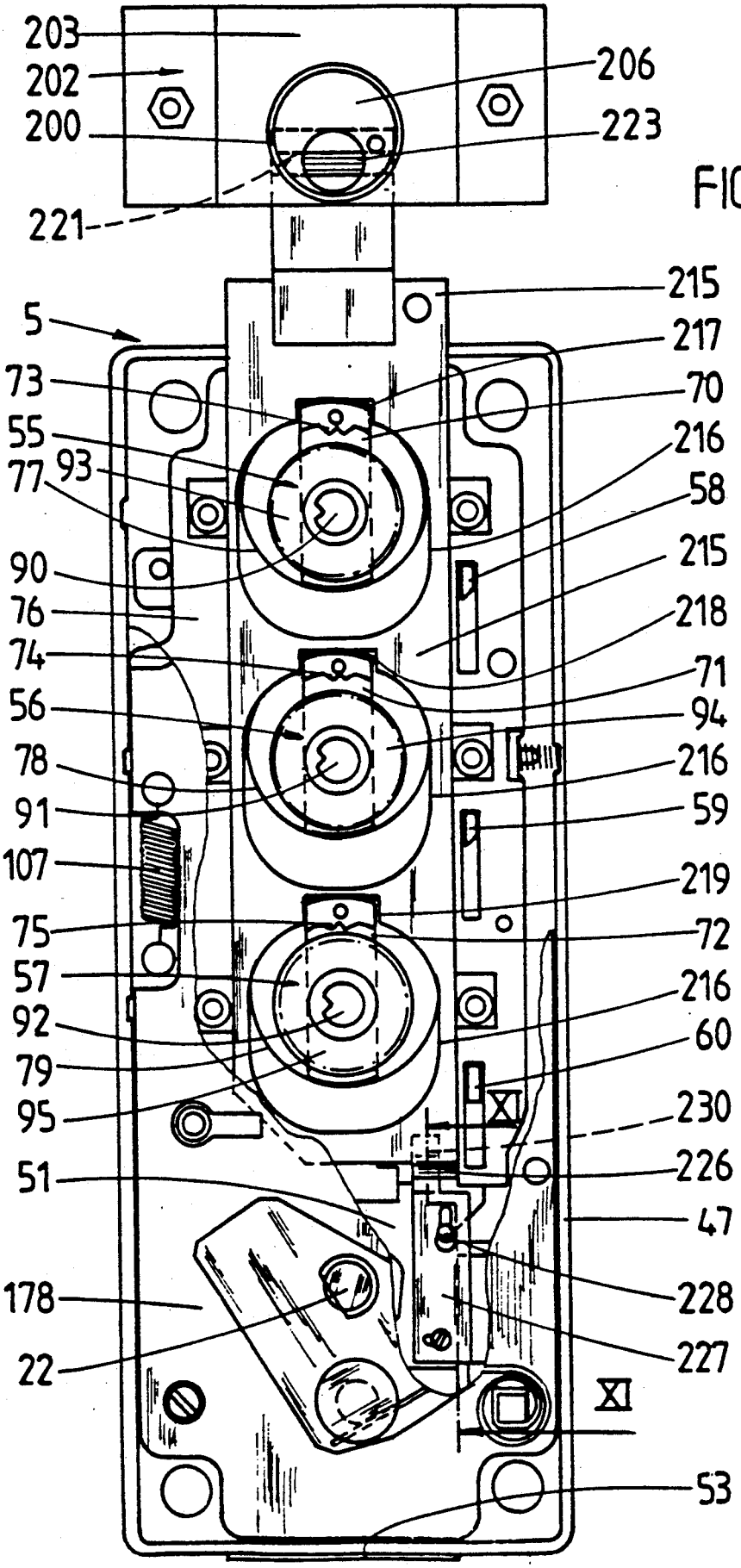
FIG. 9 is a view corresponding to FIG. 8, the slide having entered into its active position.

The permutation lock operates as follows:

The starting position of the bolt 51 should be the position indicated in FIG. 6, i.e., the bolt 51 is in its open position. The three setting knobs 7, which are connected fixed for rotation with the corresponding toothed disks 93–95, are in a position which can be pre-selected as desired by the user and will be referred to as the combination setting. The instantaneous position of the setting knobs is fixed by engagement of the detent teeth 96–98 into the toothing of the toothed disks 93–95. The reversing slide 76 is in its retracted position, i.e., it has been displaced in the direction of the arrow 108. It results from this that the diametral webs 70–72 have been displaced via the recesses 77–79 of the reversing slide 76 in such a manner that the blocking teeth 73–75 are out of engagement with the corresponding toothing of the toothed disks 93–95. The ratchet disks 55–57 arranged below the toothed disks 93–95 are so aligned that the blocking pins 58–60 of the slide 51 engage into radial slots (not shown). If the shaft 22 is now turned in counterclockwise direction by means of the actuating handle 6, then the arm 64 is swung and, by means of its pin 65 which engages into the hole 66, carries the bolt 51 along opposite the direction of the arrow 108. In the end position of this turning movement, the bolt 51 reaches its locking position, shown in FIG. 7, in which the bolt head 53 extends out of the lock case 47. In this position, the safe door 3 is locked.

By the swinging of the arm 64, the latter has caused a swinging of the control lever 80 around the pin 81 due to the arm leaving the open-edged recess 112 of the control lever 80, and coming to rest against the application surface 113 of the control lever 80. In this connection, the reversing slide 76 has been displaced via the control pin 82 and the slot 83 in a direction opposite the direction of the arrow 108. The recesses 87–89 of the reversing slide 76 have, in this connection, carried along the diametral webs 70–72, whereby their locking teeth 73–75 have come into engagement with the corresponding toothing of the toothed disks 93–95. By the placing of the bolt 51 into its locking position (FIG. 7), the blocking pins have moved out of the corresponding slots of the ratchet disks 55–57. The latter can thus be turned, which can take place by actuation of the setting knobs 7 since, via the grooves 67–69, the diametral webs 70–72 are in form-locked engagement with the ratchet disks 55–57.

Also a form-locked engagement exists between the diametral webs 70–72 and the toothed disks 93–95 due to the engagement of the locking teeth 73–75 into the toothing of the toothed disks 93–95.

Actuation of the setting knobs 7 is required so that the combination of the permutation lock 5, which has been stored upon advancing of the bolt 51, cannot be noted after locking the safe 1.

A storing of the combination has taken place by the meshing of the locking teeth 73–75 with the toothing of the toothed disks 93–95. after advancing the bolt 51, the turning of the toothed disks 93–95 is then carried out by the setting knobs 7. The ratchet disks 55–57 thus retain their relative position with respect to the toothed disks 93–95 due to the above-described form-locking. A retracting of the bolt 51 into its open position by turning the shaft 22 in clockwise direction can take place only if the radial slots of the ratchet disks 55–57 are aligned with the blocking pins of the bolt 51. This position, however, corresponds to that of the stored combination, i.e., the ratchet disks 55–57 and thus the toothed disks 93–95 must again assume the position which they had upon the advancing of the bolt.

Figure 15:
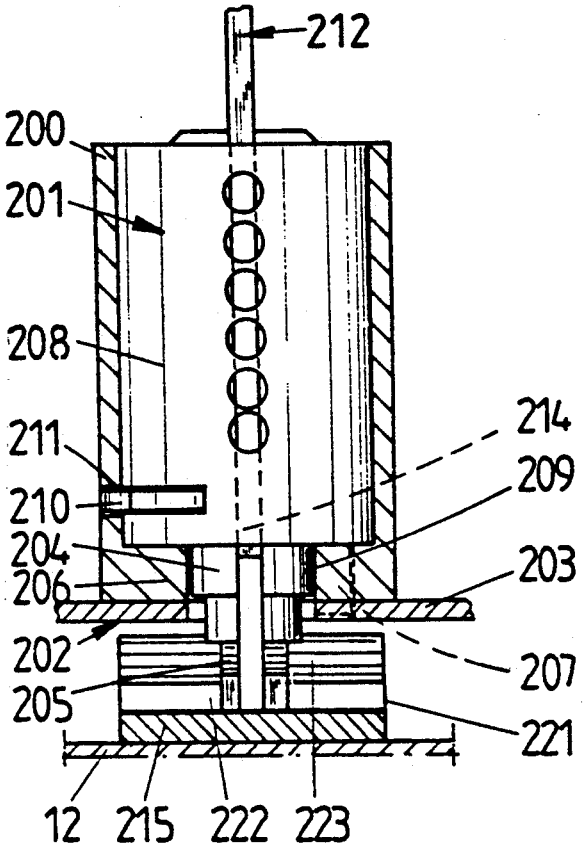
FIG. 15 is a section along the line XV—XV of FIG. 13, the emergency key being inserted.
Figure 16:
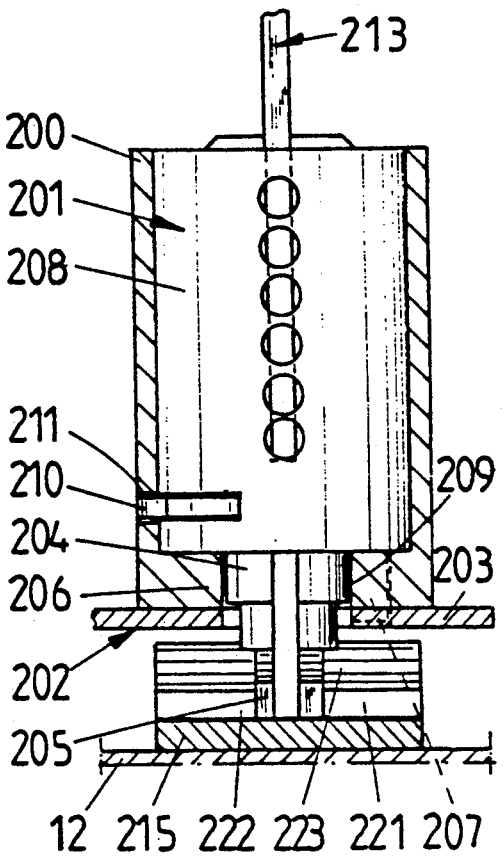
FIG. 16 is a longitudinal section corresponding to FIG. 15 with insertion of the reactivation key, which has a shorter key shaft than the emergency key.
Figure 17:
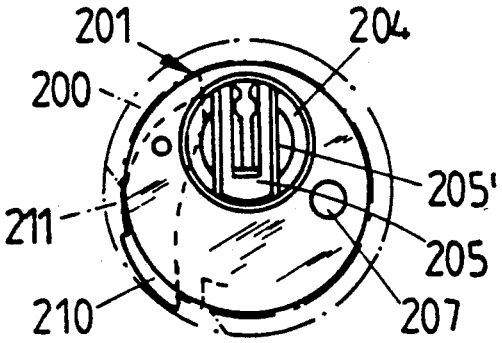
FIG. 17 is a bottom view of the lock cylinder shown in FIG. 15, the lock cylinder being in key removal position, as seen in the direction of the locking member.

If the user of the safe has forgotten the combination after advancing the bolt 51 and setting the combination, then he must get in touch with an authorized person who has the emergency key 212. This key is inserted into the lock cylinder 201, see FIG. 15. By means of the latter, the cylinder core 204 with its locking member 205 can be displaced solely by a partial turn. During this partial turn, the blocking web 210 which is urged radially outward under spring action was retracted into the lock cylinder housing 208 by the key shank end 214 so that the lock cylinder 201 can then be removed from the mount 200 by means of the emergency key 212. The supporting shoulder is thereby removed from the control projection 221 so that the slide 215 can advance under spring action. By means of the setting knob 7 which is closest to the actuating handle 6, a turning displacement of the ratchet disk 57 with the diametral web 72 must now be effected. As soon as the diametral web is aligned with the niche 219 of the radial recess 216, the slide 215 can advance by a small amount. The setting knob in the middle, as well as the next one, must then also be turned, whereby the diametral webs engage in succession into the associated niches, which permits the remaining advance of the slide 215.

Figure 11:
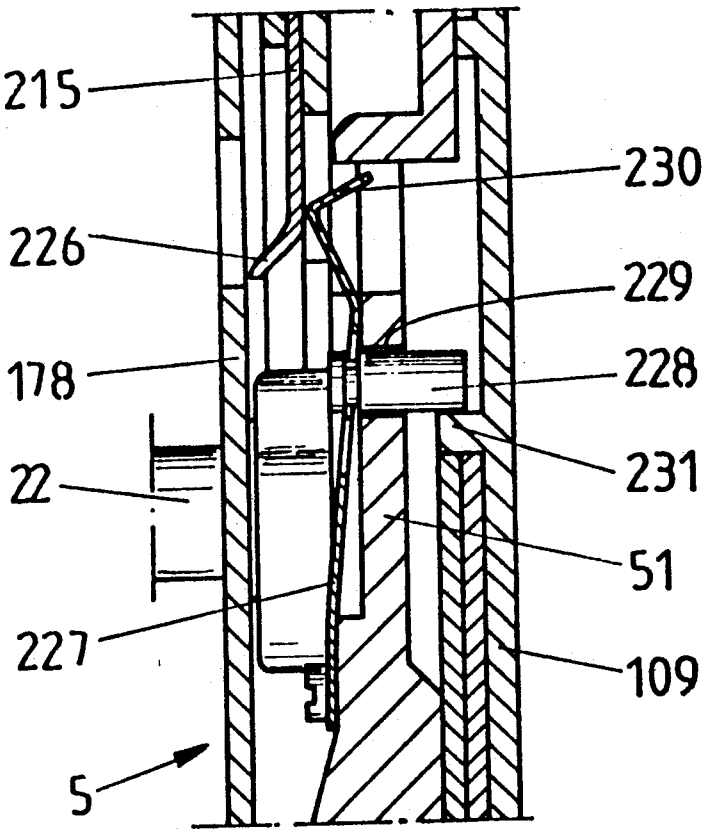
FIG. 11 is a section along the line XI—XI of FIG. 9.
Figure 10:
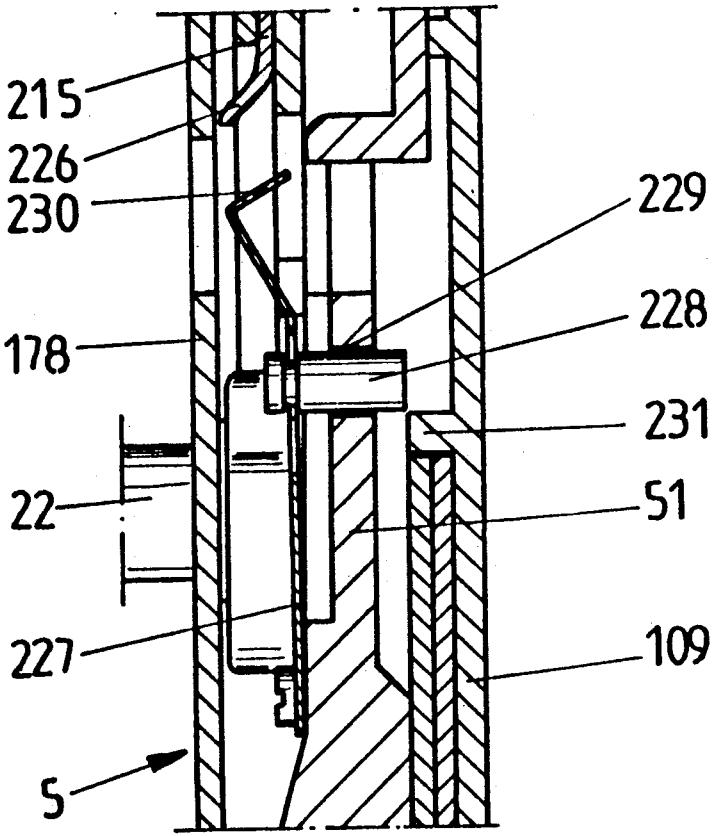
FIG. 10 is a section along the line X—X of FIG. 8.

The corresponding position of the setting knobs 7 now corresponds to the combination previously set. Upon the retracting of the bolt 51 into its open position, the form-lock between the diametral webs 70–72 and the toothed disks 93–95 is eliminated, so that the new combination can be set. At the same time, however, the end 230 of the leaf spring 227 passed under the lug 226 upon the retraction of the bolt 51 into its open position, whereby the leaf spring is displaced in the direction of the facing broad surface of the bolt together with a carrying along of the blocking pin 228, which moves from the position indicated in FIG. 10 into that indicated in FIG. 11, and thus moves in front of the blocking shoulder 231 of the housing 47. Although the correct combination is then present, the bolt 51 cannot be advanced again by the actuating handle 6.

If the holder of the emergency key 212 now attempts to insert the lock cylinder 201 by means of the emergency key, then the locking member 205 acts on the supporting surface 224 of the control projection 221 of the slide 215. The lock cylinder 201 can thus not be completely installed even if the locking member 205 is turned through the limited angle of rotation by means of the emergency key 212. The opening of the safe 1 thus leaves traces which reside in the locking cylinder not being installed. The emergency opening mechanism must accordingly again be brought into its starting position.

Figure 18:
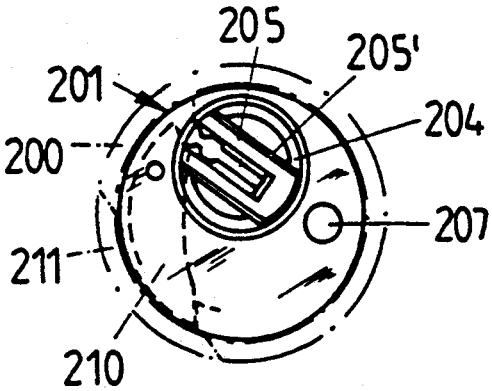
FIG. 18 is a view corresponding to FIG. 17, the locking member being turned and the blocking segment being brought out of engagement with the mount.
Figure 19:
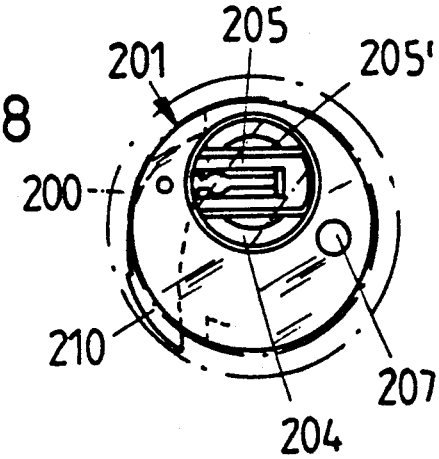
FIG. 19 is a view corresponding to FIG. 17, namely with insertion of the reactivation key by means of which the locking member has been turned into a position which permits insertion of the lock cylinder and coupling with the slide.
Figure 20:
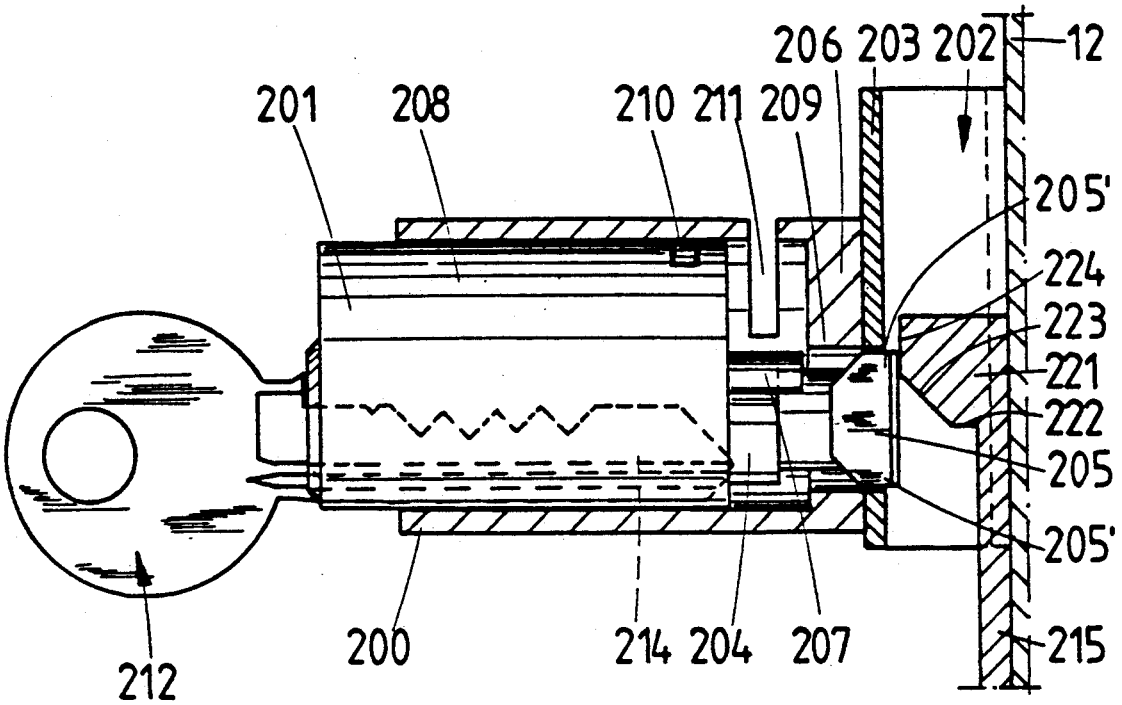
FIG. 20 is a view corresponding to FIG. 12, the emergency key being inserted and an attempt being made at inserting the lock cylinder which is prevented by the control projection of the slide.
Figure 21:
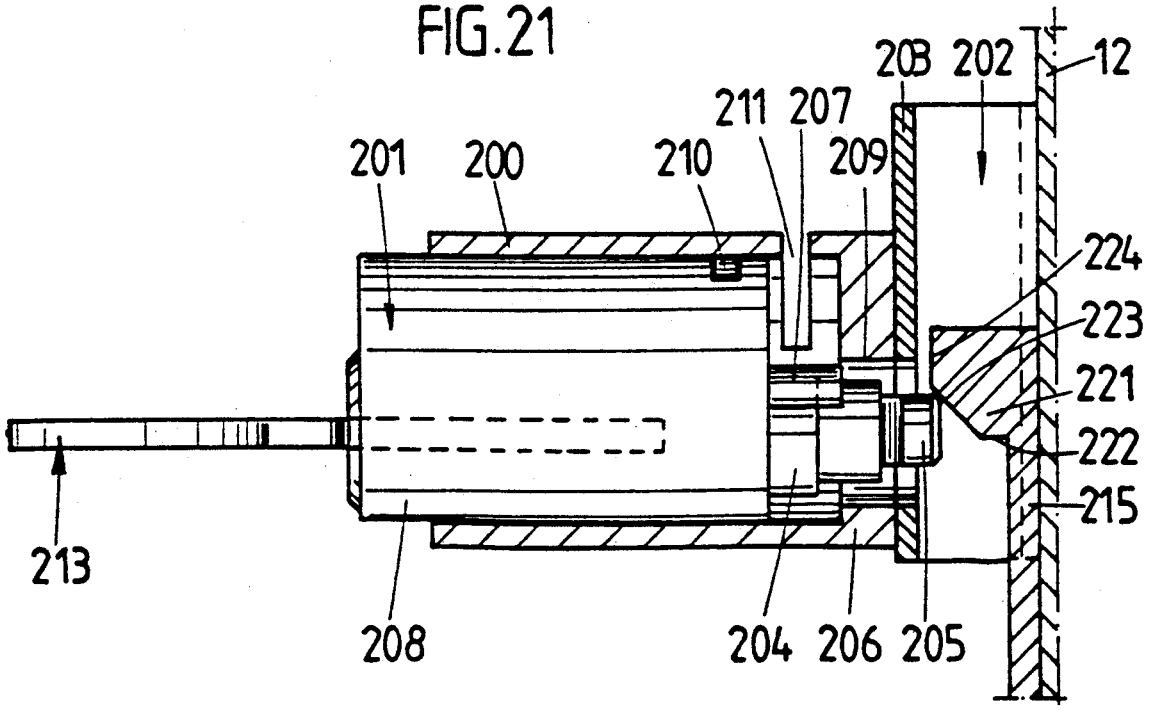
FIG. 21 is also a view similar to FIG. 12, the reactivation key being inserted and the locking member being turned into the coupling position, the locking member acting on the latch bevel of the control projection.
Figure 22:
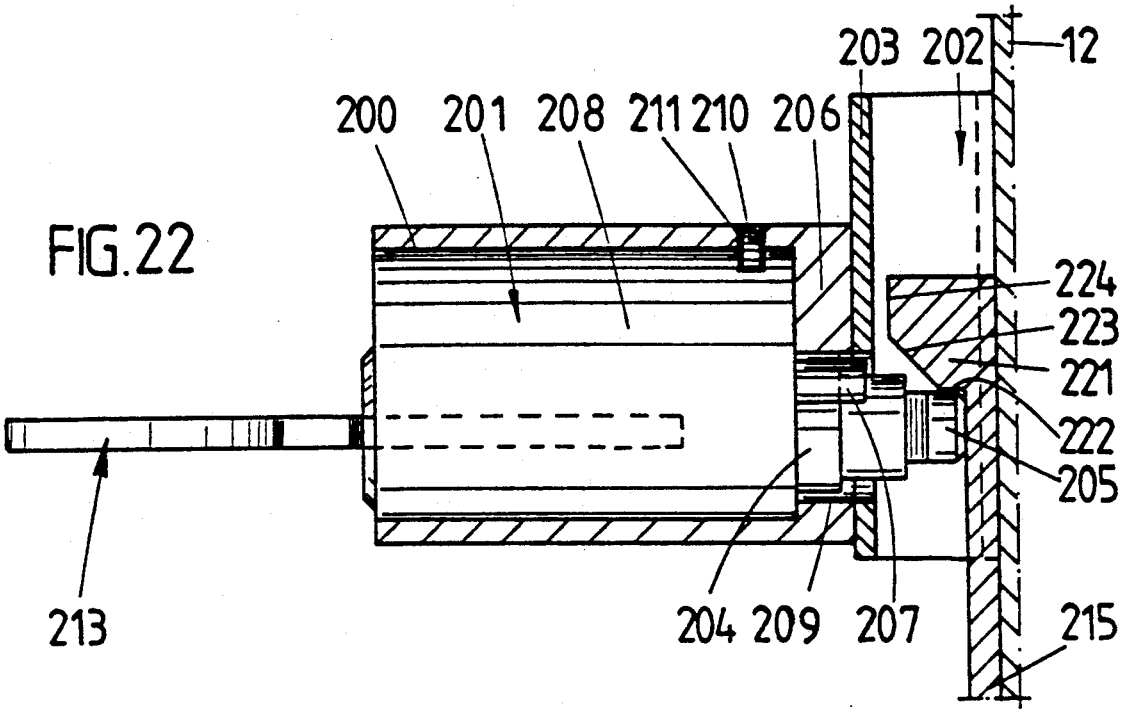
FIG. 22 is a sequential showing following FIG. 21.
Figure 23:
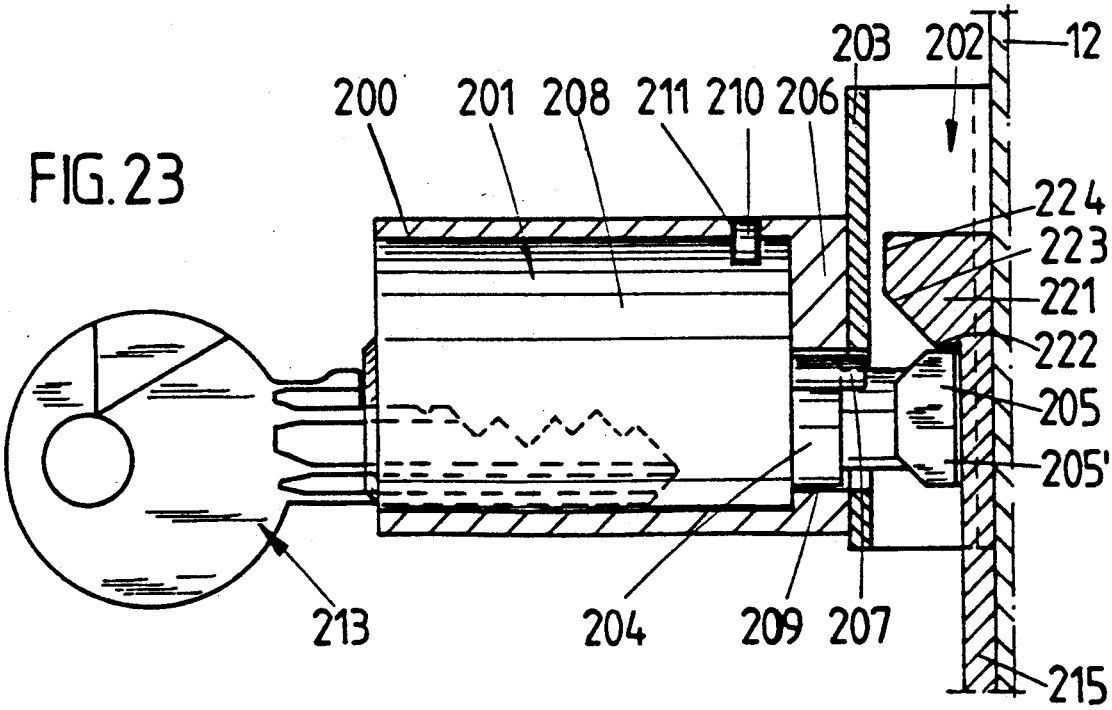
FIG. 23 is a further sequential showing, the reactivation key being turned into the key removal position.

The starting position must be brought about by another person, for instance someone from the hotel management, by use of the reactivation key 213. This reactivation key makes it possible to turn the locking member 205 beyond the position shown in FIG. 18 into the position shown in FIG. 19. In this way, the lateral wings 205, of the locking member 205 pass into a 90° transverse position to the control projection 221 and are thus at the level of the latch bevel 223 of the control projection 221. If the lock cylinder is now pushed further into the mount 200, then the slide 215 is retracted out of the position shown in FIG. 21 into the position shown in FIG. 22 in which the control projection 221 rests with its step 222 on the locking member 205. In this position, the rotation-prevention pin 207 has entered into its corresponding recess. At the same time, the blocking web 210, which was held back before insertion of the lock cylinder, has been able to engage into the corresponding radial recess 211 of the mounting 200. The starting position of the slide 215 can be reached in the manner that the locking member 205 is moved by the reactivation key 213 into the position shown in FIG. 23, while moving the slide 215 back into its starting position. In this connection its lug 226 releases the leaf spring 227 so that the latter moves the blocking pin 22 back into the release position. The permutation lock 5 can now again be actuated in the manner described above since the niches 217–219 have released the diametral webs 70–72 and do not form an obstacle to a resetting of the combination.

The coin lock 19, which is shown in particular in FIGS. 24 to 30, has a box-like lock case 114 which has a lock front wall 115 and bent-off lock case sidewalls 116 to 119. The lock mechanism is covered by a lock rear wall 120 which is held by a screw 122 which enters a square pin 121 of the lock case 114.

In the lock case 114, a locking slide 123 is mounted for displacement in the direction of the double arrow 124. A bolt tail 125 serves for the guidance of the locking slide 123, the bolt tail having a slot 126 into which the square pin 121 engages.

A pawl 128 is mounted above the locking slide 123, the pawl being swingable around a support pin 127 on the lock case, which is located in the corner region between the lock case sidewalls 116 and 119. A leaf spring 129 acts in clockwise direction on the pawl 128, the pawl 128 resting with a locking tooth 130 against a toothed recess 131 of the locking slide 123.

The upper lock-case sidewall 116 continues into a bulge 132 which forms on its oblique flank 133, which faces the lock-case sidewall 119, a chute 134 of a coin-insertion plate 135. The latter is provided with two calibrated coin-insertion slots. The coin-insertion plate 135 is in such a position that one of the coin-insertion slots is open. As a result, a coin can be inserted into the coin lock 19. By pulling the coin-insertion plate 135 out and turning it by 180°, it can assume a position in which the other coin slot can be used.

In the rear region of the locking slide 123, a lever 136 extends between the lock rear wall 120 and the locking slide 123. The lever is mounted on a pin 137 on the top side of the locking slide 123. The lever 136 is provided in its central region with a bearing bore hole 138 for receiving a rotary cam 139. The bearing bore hole 138 forms two diametrically opposite detent niches 140 into which diametrically opposite detent projections 141 of the rotary cam 139 extend. The rotary cam 139 has a slot 142 for a resetting tool (not shown). The end 143 of the rotary cam 139, which is opposite the slot 142, protrudes beyond the rear side of the lever 136 and is provided with a flattening 144 so that an eccentric is formed. The end 143 extends up to the lock front wall 115 and forms there a first support point for a coin 145, see also FIG. 29; the coin 145 is shown in several positions in FIG. 25.

Opposite the support point (end 143), there is a bolt-side support point 146, the distance between these two points being smaller than the diameter of the coin 145. A collar 147 extends from the lever 136 within the region of the rotary cam 139 and passes through an opening 148 in the locking slide 123 (see, in particular, FIG. 29).

Figures 24, 25:
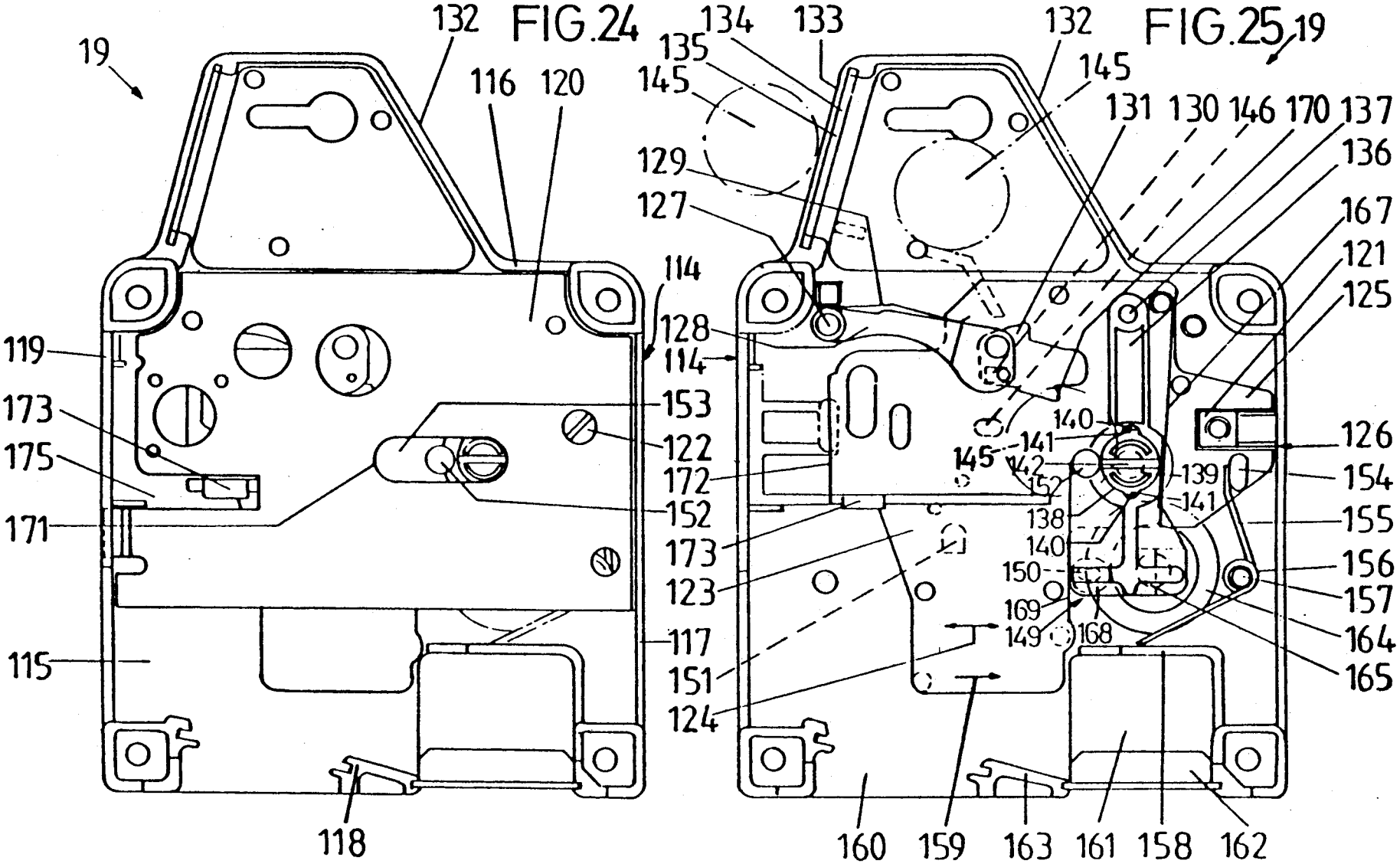
FIG. 24 is a rear view of a coin lock attached to the hotel room safe.
FIG. 25 is a rear view of the coin lock in the position in accordance with FIG. 24, the lock cover being omitted.

At its end 149 which corresponds to the direction of fall of the coin, the lever 136 is provided with a second support point 150 which is at a distance from a second bolt support point 151 in the normal position of the lever 136, see FIG. 25. The side of the lever 136 facing the rear wall 120 of the lock is provided with a control cam 152 which engages into a slot-like opening 153 in the rear wall 120 of the lock, which opening lies in the direction of displacement of the bolt. A projection 154 is provided on the locking slide 123 for a spring 155 which acts on the locking slide 123, the spring resting with its free end against the projection 154.

The spring it grips with its central coiled region 156 around a pin 157 of the lock case 114 and rests with its other end against a wall 158 of the lock case 114. The locking slide 123 is thereby urged in the direction of the arrow 159.

Two coin-discharge openings 160 and 161 are developed below the locking slide 123. The coin-discharge opening 161 is developed as coin-return compartment by a removable bottom wall 162. It can be noted from FIG. 25 that the path of fall of the coin return is located above an inclined intermediate wall 163, between the two coin-discharge openings 160 and 161.

In order to make the return of a coin possible, the front wall 115 of the lock bears, in a thickening of material 164 (see FIG. 28), a coin-return button 165 which is acted on by a compression spring. The end of this button facing the lever 136 is shaped as a cone and cooperates with an oblique surface 166 of the lever 136 (see FIG. 29). If the coin-return button 165 is pushed in the direction of the arrow shown in FIG. 28, then its end acts on the oblique surface 166 of the lever 136 so that the latter is swung in such a manner that the distance between the eccentric end 143 of the rotary cam 139 and the bolt support point 146 becomes larger than the diameter of the coin 145. The coin 145 then drops through, is guided toward the inclined intermediate wall 163 and passes from there to the coin-discharge opening 161. In order for the lever 136 always to assume its normal position and also return into it upon swinging, it is urged in clockwise direction by leaf spring 167.

The lever 136 is imparted its stop position in the manner that a collar 168, which surrounds the support point 150, acts on the corresponding narrow edge 169 of the locking slide 123; see, in particular, FIG. 25.

Figure 26:
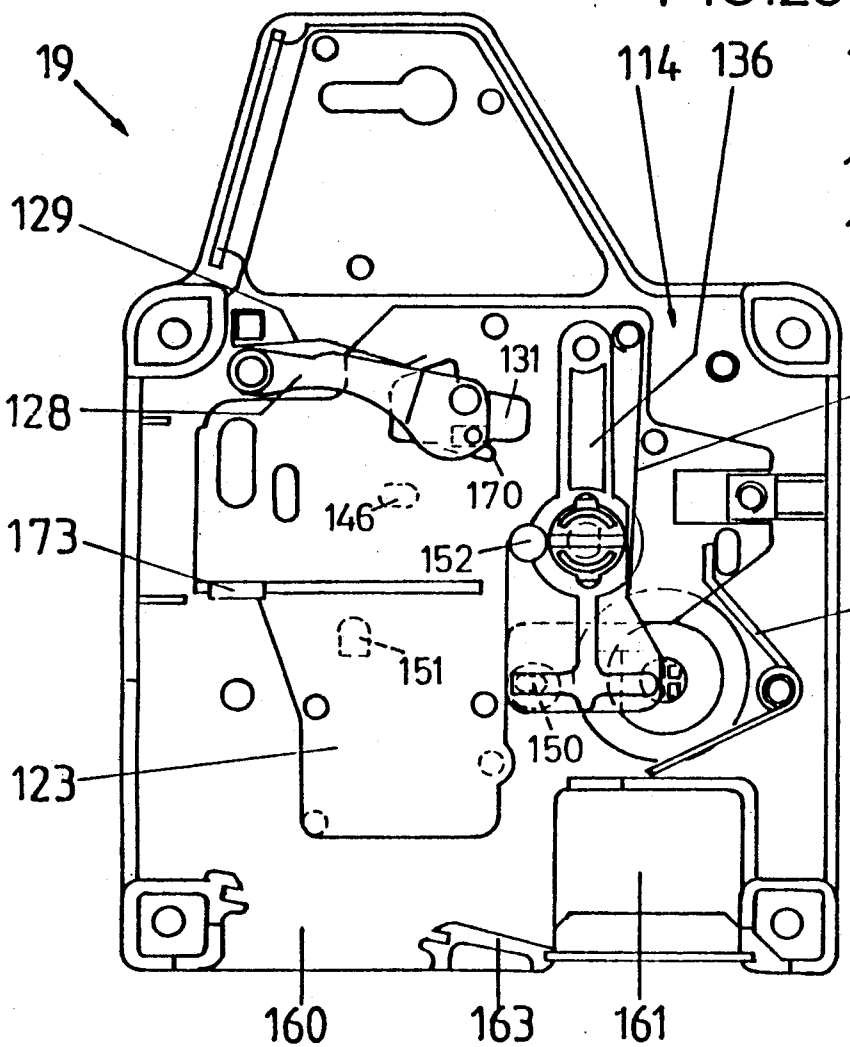
FIG. 26 is a rear view of the coin lock in accordance with FIG. 25, but in the intermediate position of a locking slide.
Figure 29:
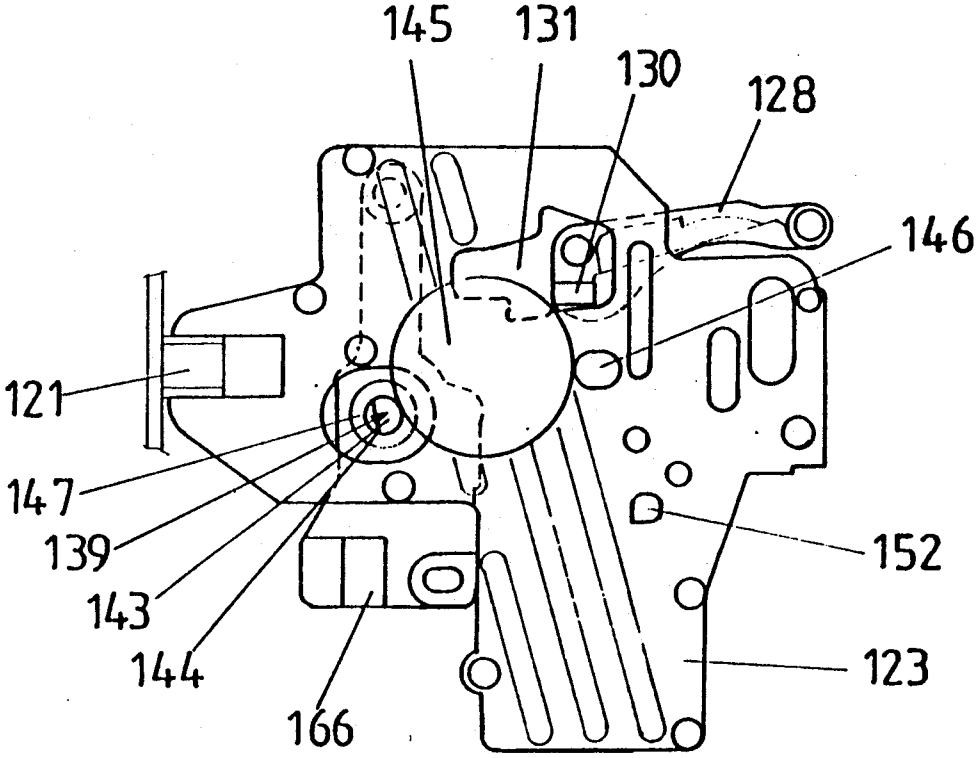
FIG. 29 is an outer view of the locking slide of the coin lock with inserted coin.
Figure 28:
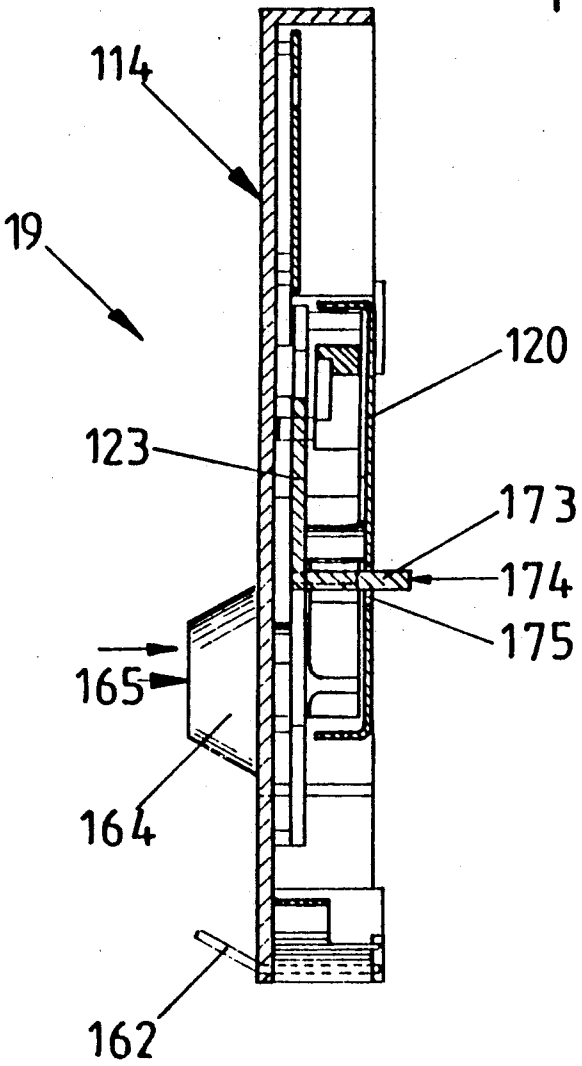
FIG. 28 is a side sectional view through the coin lock.

When setting the coin lock 19 to single-coin operation, the rotary cam 139 is in such a position that the flat 144 on the end 143 faces away from the first bolt support point 146. If the proper coin 145 is inserted, it travels through the positions shown in dash-dot line in FIG. 25 and passes into a support position which is defined by the support point at the end 143 and the bolt support point 146. In FIG. 25, the locking slide 123 is in its open position. If the advancing of the locking slide 123 is now to commence, it is moved in a direction opposite the direction of the arrow 159 in FIG. 25. During the advancing movement, the edge of the coin 145 acts on the locking tooth 130 of the pawl 128. The pawl 128 is thereby raised so that it comes out of the path of movement of a blocking shoulder 170 of the recess 131. This position is shown in FIG. 26. From this position, the locking slide 123 can thus be completely advanced. In the final phase of the advancing movement, the control cam 152 of the lever 136 acts on the edge 171 of the opening 153 (see, in particular, FIG. 24). Due to the fact that the locking slide 123 then continues to move, the distance between the support point at the end 143 of the rotary cam 139 and the bolt support point 146 becomes larger than the diameter of the coin 145, so that the latter drops down and emerges from the coin-discharge opening 160.

If it is desired to convert the coin lock 19 to multi-coin operation, this can be effected in the manner that the rotary cam 139 is turned 180° by means of a conversion tool (not shown), which is introduced into the slot 142. The flat 144 on the end 143 then faces the bolt support point 146. The distance between these two points is then greater than the diameter of the coin 145. This distance is also greater than the distance between the second support point 150 of the lever 136 and the second bolt support point 151. The coin 145 first introduced accordingly rests against the second bolt support point 151 and the second support point 150. The coin 145 which is then introduced finds its support then on the upper edge of the first coin 145. It cannot, therefore, drop down even though its diameter is smaller than the distance between the points at the end 143 of the rotary cam 139 and the support point 146. During its advance, the coin 145 which was inserted last then displaces the pawl 128 in the manner described above. When the locking slide 123 has been pushed forward, the lever 136 is then also moved out of its holding position so that the coins 145 can drop down out of their supported position. The collection of the coins 145 (coin-discharge opening 160) or the return thereof (coin-discharge opening 161) then takes place in the same manner as described above.

Figure 27:
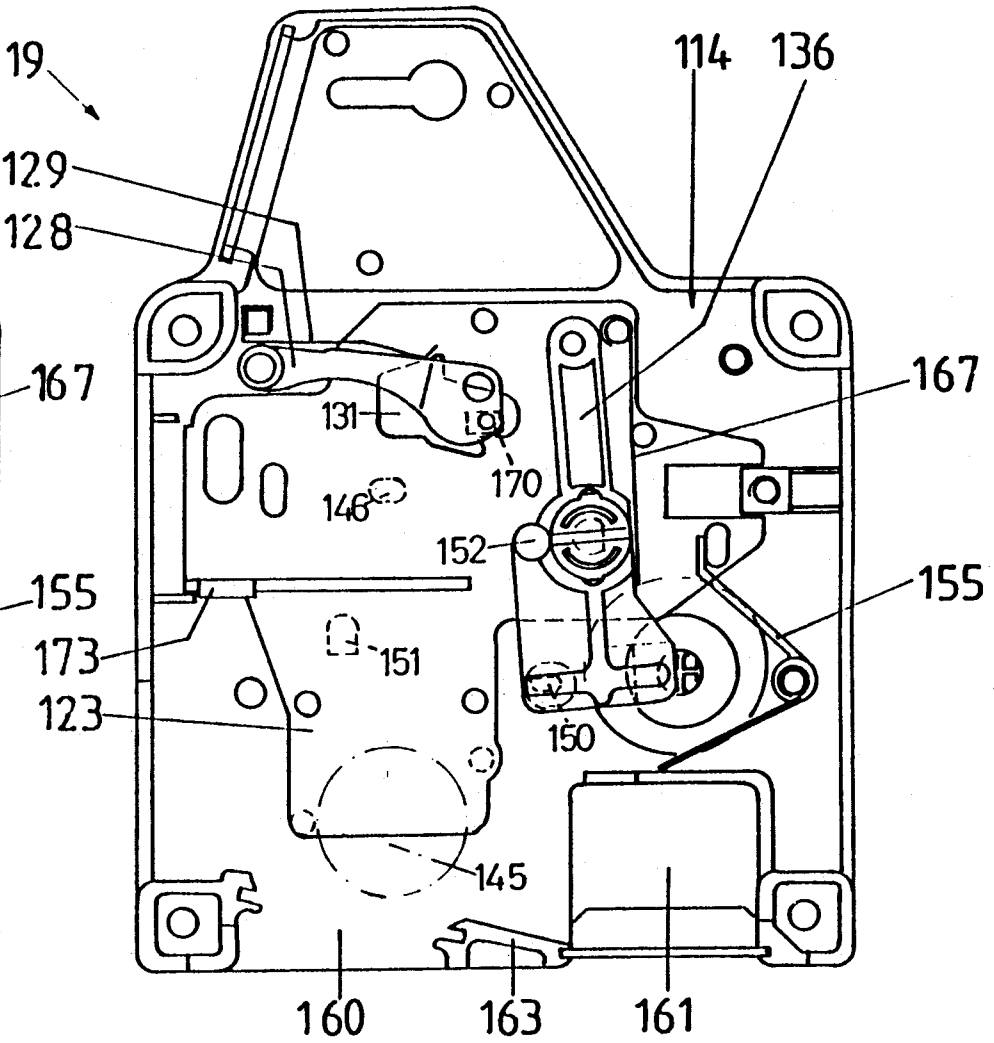
FIG. 27 is a rear view of the coin lock in the locking position.

It may also be pointed out that FIG. 27 shows the locking slide in its locking position in which the lever 136 is deflected so that the coin 145 is released.

Near the edge 172 of the locking slide 123, the latter has a projection 173 which extends perpendicular to the plane of the lock front wall 115. The length of the projection 173 can be noted particularly clearly from FIG. 28. The end 174 of the projection 173 extends beyond the lock rear wall 120, passing through an open-edge recess 175 in said lock rear wall.

FIG. 30 shows the relative arrangement of the permutation lock 5 with respect to the coin lock 19 on the safe door 3. The two locks 5 and 19 assume a back-to-back position with respect to each other. The inner wall 12 of the safe door 3 extends between the two locks 5 and 19. The permutation lock 5 rests against the inside of the inner wall 12, while the coin lock 19 is arranged on the outside 18 of the inner wall 12. In accordance with FIGS. 2 and 30, the inner wall 12 has an opening 176, the coin lock 19 being so attached to the inner wall 12 that the free end 174 of the projection 173 of the locking slide 123 passes through the opening 176. The permutation lock 5 is in such a position that the extension 111 of the bolt 51 comes to lie above the opening 176. The extension 111 of the bolt 51 rests against the projection 173 of the locking slide 123, whereby an entrainment connection 177 is formed.

The safe of the invention operates as follows:

If a user wishes to use the safe, for instance in order safely to store valuables, he first of all opens the safe door which was left in unlocked position by the previous user. After placing his valuables into the safe, he inserts a coin 145 into the coin-insertion plate 135 of the coin lock 19. If the coin lock 19 is set to two-coin operation, then the insertion of two coins 145 is required. The conversion from single-coin operation to two-coin operation can be effected as described above.

After insertion of the coin, he closes the safe door 3 and then selects his personal combination on the setting knobs 7. He then locks the safe door 3. This is effected by turning the actuating handle 6 of the permutation lock 5. By turning the actuating handle 6, the bolt 51 of the permutation lock 5 is brought into its locking position, the bolt head 53 coming into engagement with mating locking parts present on the frame of the safe door.

By the displacement of the bolt 51, on the one hand, the combination is stored as described above and, on the other hand, entrainment of the projection 173 of the locking slide 123 of the coin lock 19 takes place. Since the user has inserted a coin 145 into the coin lock 19, the locking slide 123 can be completely carried along by the bolt 51 since the edge of the coin raises the pawl 128 as described above, so that there is no resistance to the displacement of the locking slide 123.

However, if the user has not inserted a coin into the coin lock 19, then complete displacement of the locking slide 123 cannot take place since the locking tooth 130 of the pawl 128 moves against the blocking shoulder 170 of the recess 131 so that, in this way, the bolt 51 cannot be brought into its locking position, due also to the entrainment connection 177. Locking of the permutation lock 5 is thus not possible. The locking can, accordingly, only take place if a coin has been inserted.

In the end position of the locking there takes place—as described above—a displacement of the lever 136 of the coin lock 19, as a result of which the coin 145 drops out of the coin-discharge opening 160 and passes into the coin-collection chamber 15 via the coin-drop shaft 24 and the connecting coin chute 23 of the safe door 3. The user now makes a note of his combination (if he has not already done so) and scrambles the setting knobs 7.

If the user later on wishes to open the safe door 3, he will, therefore, first set his combination on the setting knobs 7, whereby the permutation lock 5—as described above —is released. By turning the actuating handle 6, the bolt 51 of the permutation lock 5 can then be moved back. The opening of the safe door is thus possible. By this movement into the unlocking position, the coin lock 19 is also again brought into its original position via the entrainment connection 177. The user, or some later user, can then use the safe again in the manner indicated.

It is evident from the above that the object of the invention thus always makes the insertion of a coin necessary in order to advance the permutation lock 5, the combination of the permutation lock 5 being stored upon the advancing.

The emptying of the coin-collection chamber 15 can take place outside of the presence of the user of the safe since the opening of the safe door 3 is not required for this. Rather, an authorized person will loosen the fastening element 29 with a key in order to remove the cover 11, whereby the coin-collection chamber 15 is made accessible. The authorized person has, in this connection, no access to the inside of the safe since the coin-collection chamber 15 is screened off from the safe chamber by the inner wall 12.

FIGS. 31 to 38 show a further embodiment of the invention which differs from the above-described embodiment in that a coin-lock lock cylinder 179 is inserted. Otherwise reference is had to the description of the previously described embodiment.

Figure 32:
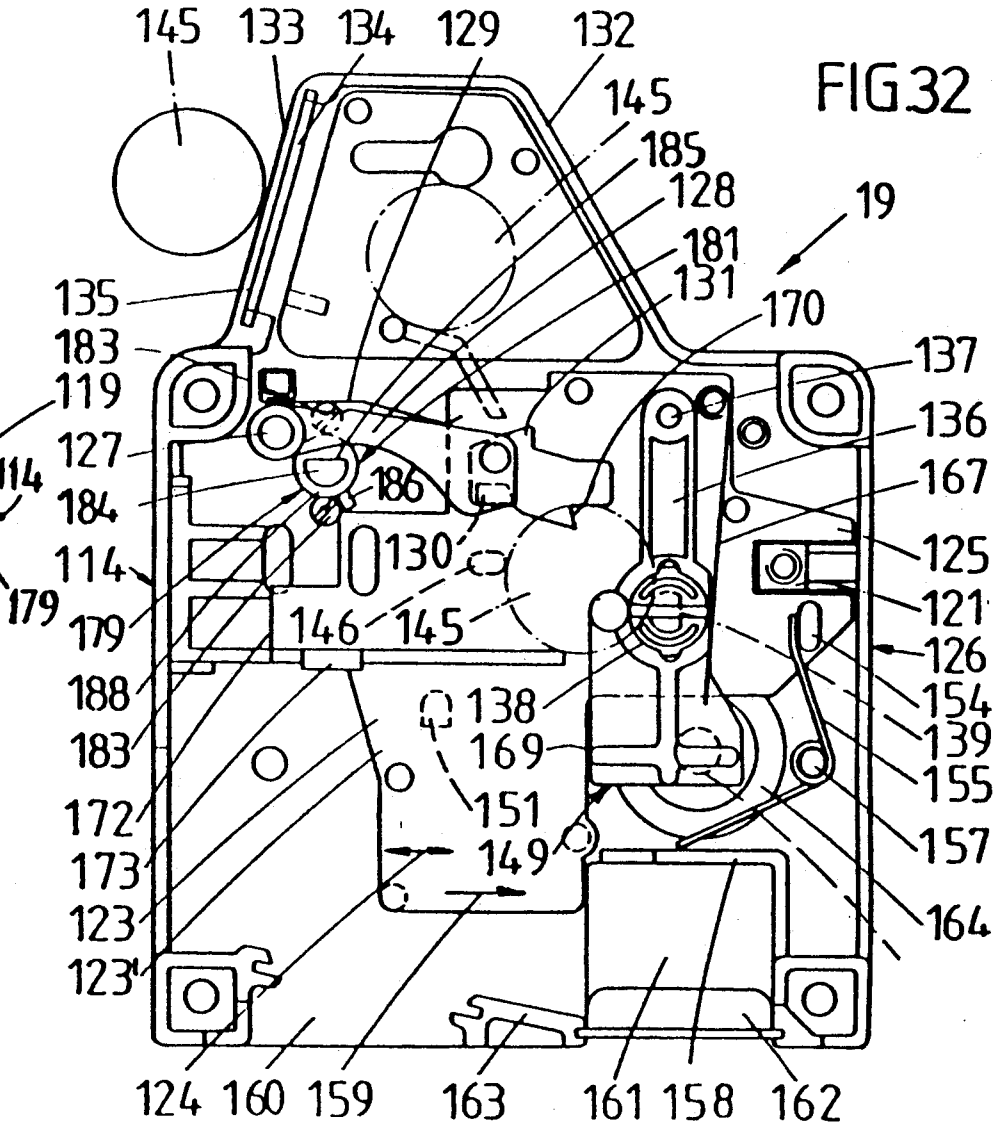
FIG. 32 is a rear view of the coin lock in open condition from which the insertion of a coin can be noted in dash-dot line, the coin-lock lock cylinder which can be used for unlocking being in non-engaged position.
Figure 31:
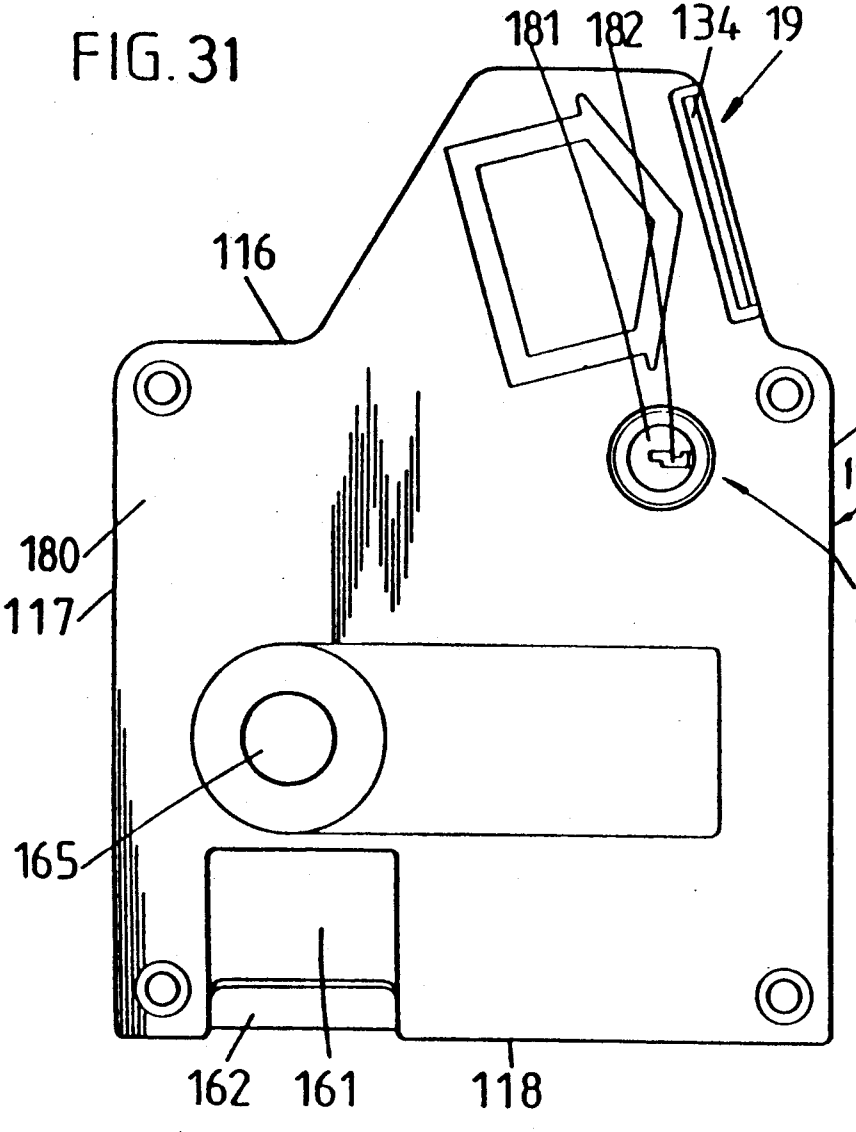
FIG. 31 is a front view of a coin lock cooperating with the permutation lock, the coin lock being equipped with a coin-lock lock cylinder.
Figure 33:
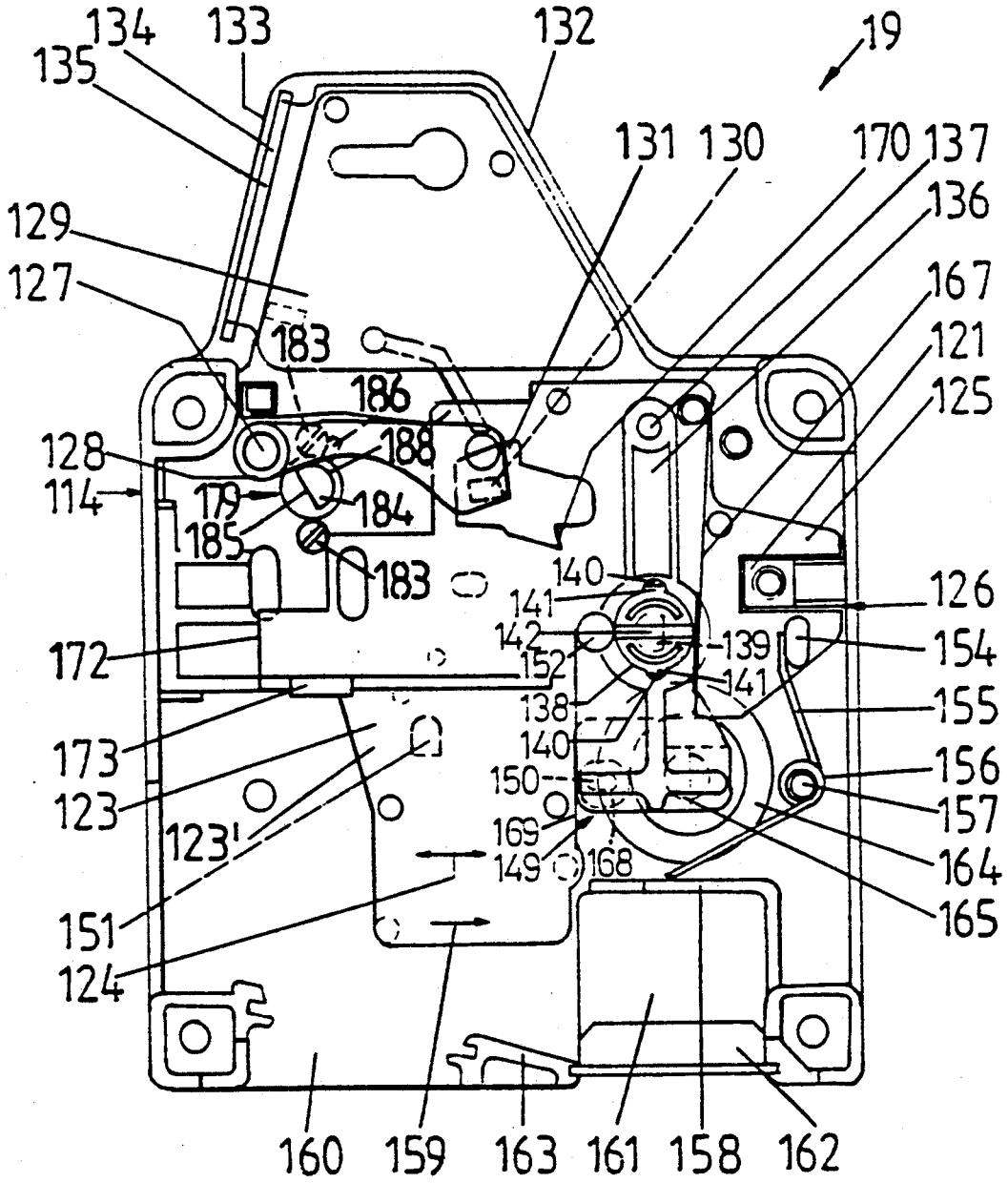
FIG. 33 is a rear view in accordance with FIG. 32, but without the insertion of a coin and in the advanced position of the coin-lock lock cylinder.
Figure 35:
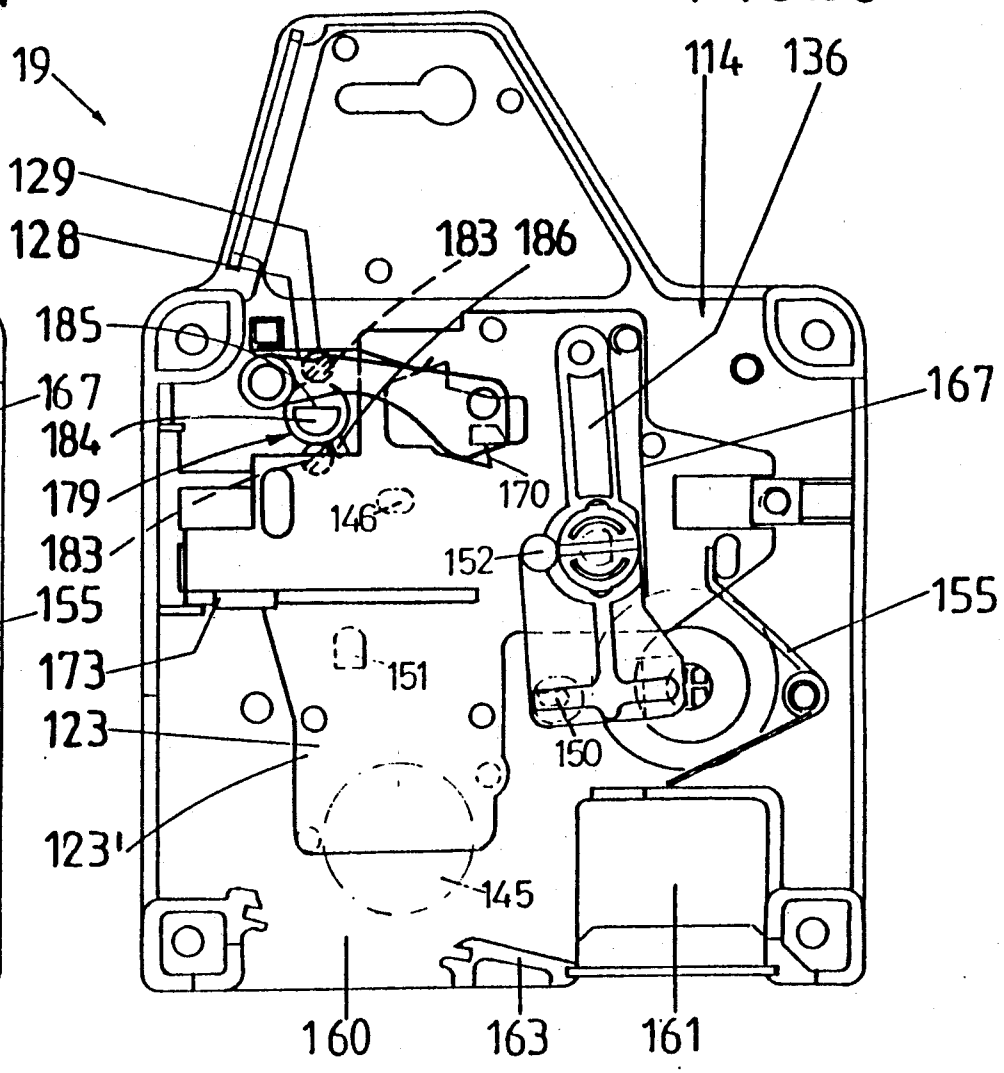
FIG. 35 is a rear view of the coin lock in accordance with FIG. 34, with the locking slide displaced into the end position.
Figure 34:
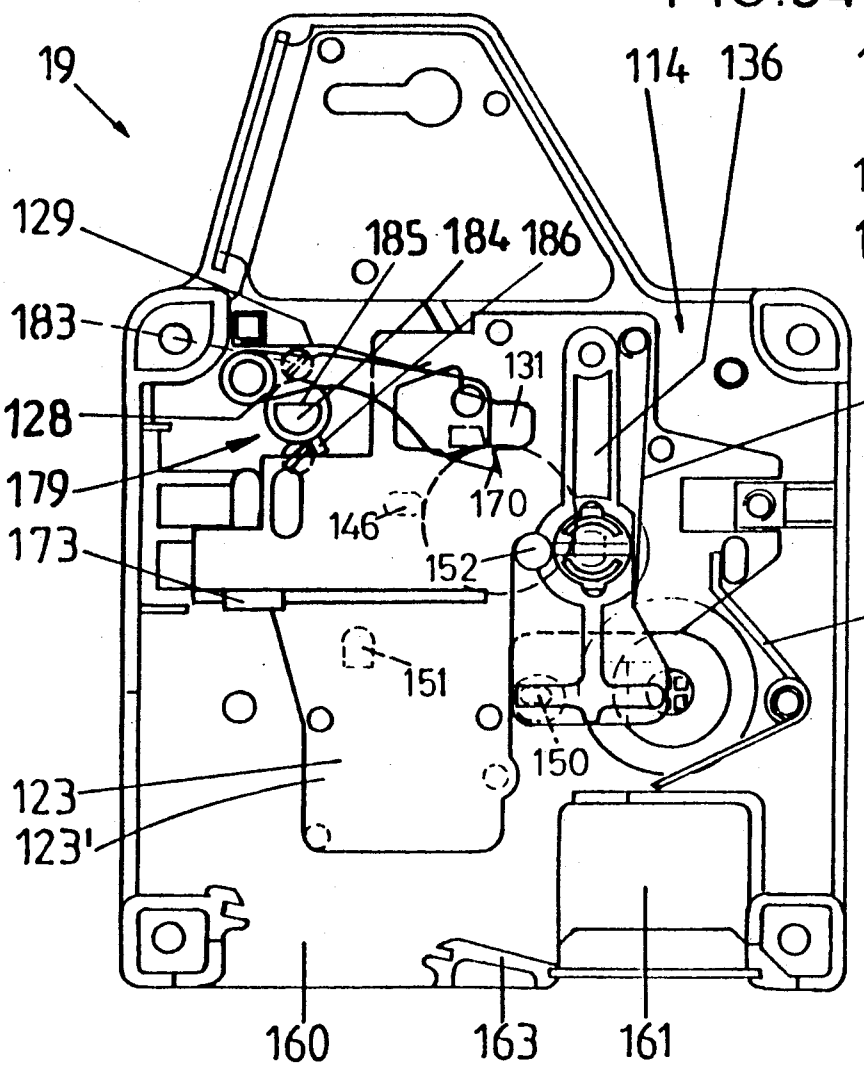
FIG. 34 is a rear view of the coin lock with displaced locking slide.
Figure 37:
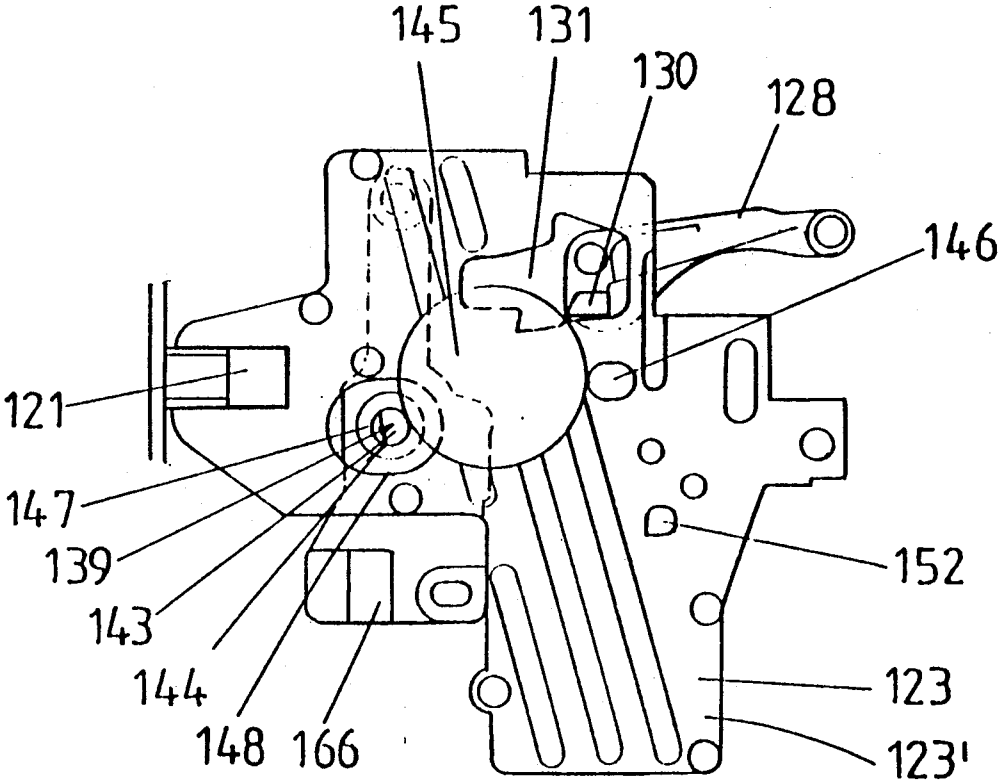
FIG. 37 is an outer view of the locking slide with inserted coin.
Figure 36:
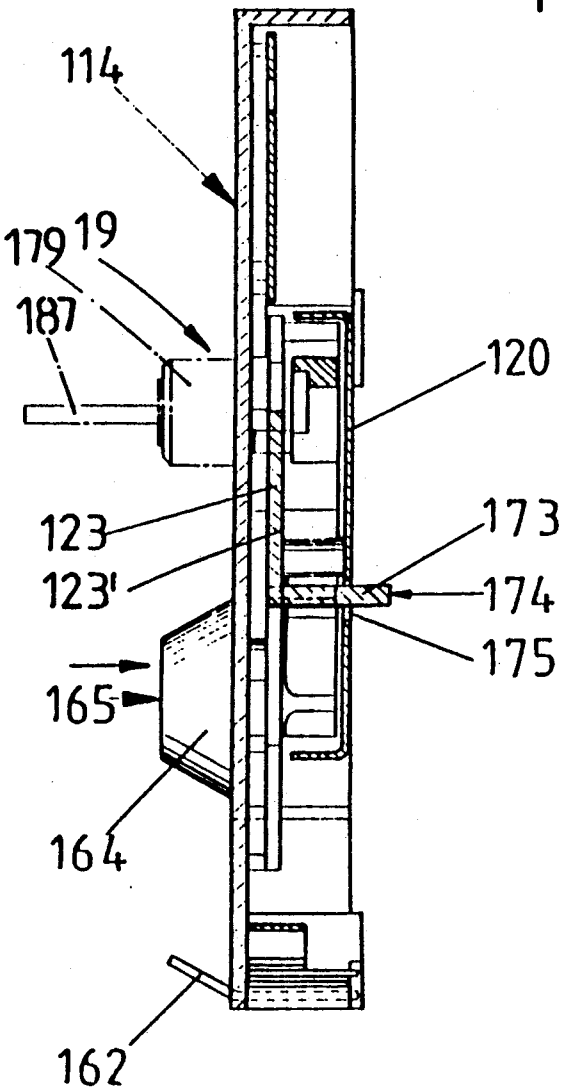
FIG. 36 is a lateral sectional view through the coin lock provided with the coin-lock lock cylinder.
Figure 38:
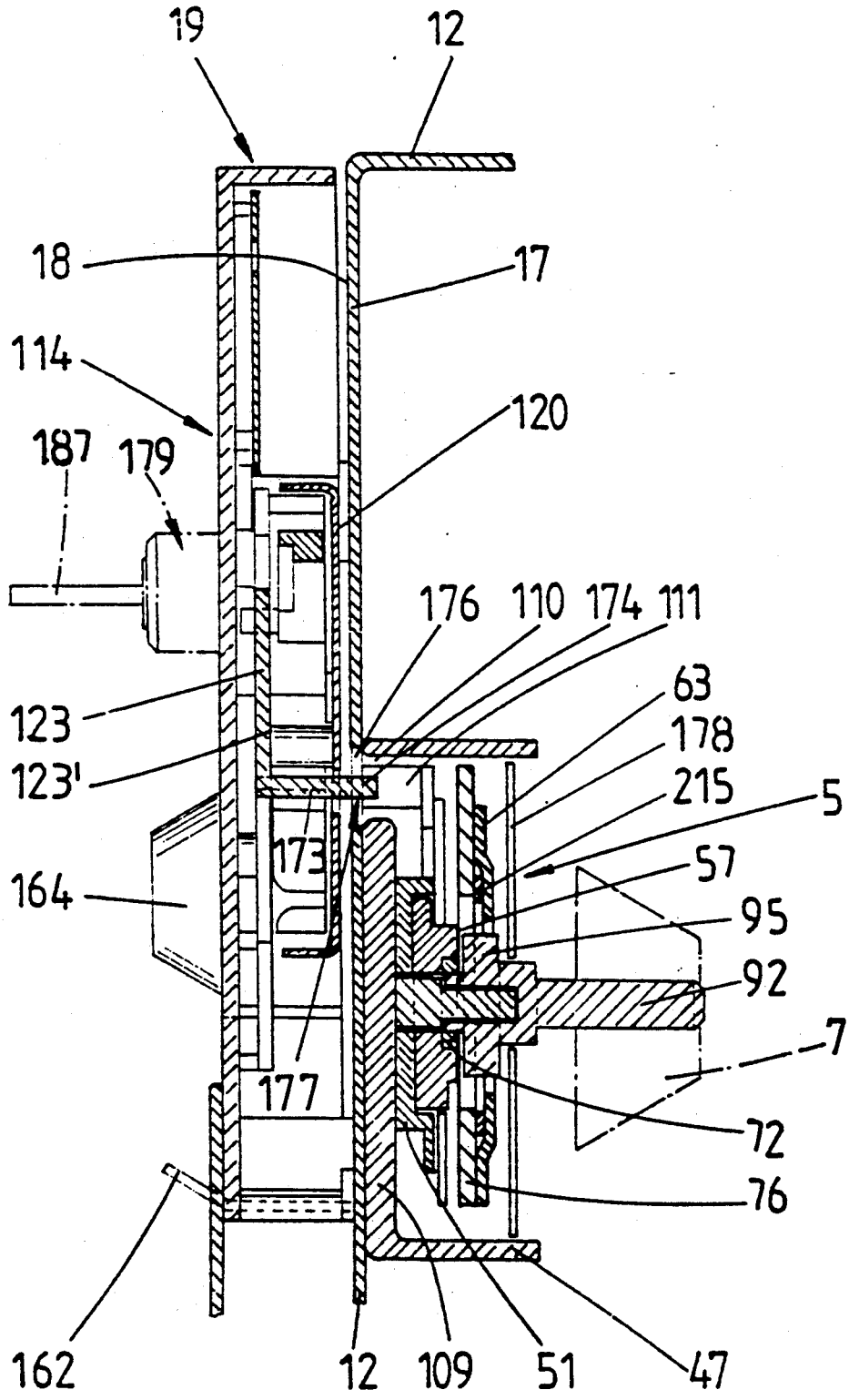
FIG. 38 is a sectional view of a region of the safe door from which the back-to-back arrangement of permutation lock and coin lock can be noted.

It can be noted in particular from FIGS. 31 to 36 that the coin lock 19 has a lock cylinder 179 arranged on its front side 180. The lock cylinder is provided with a cylinder core 181 which has a key channel 182. FIG. 32 shows a rear view of the lock cylinder 179. It can be noted therefrom that it is attached by means of two threaded screws 183 which pass through the front side 180 of the coin lock 19. The cylinder core 181 has a locking bit 184 which has a circular cylindrical shape with a flattening 185. A radially extending stop pin 186 is attached to the locking bit 184, the stop pin being able to cooperate with the heads of the threaded screws 183. In this way, the angle of rotation of the locking bit 184, and thus of the key 187 for the lock cylinder 179, is limited, the end position of the range of the angle of rotation being defined by application of the stop pin 186 against the heads of the threaded screws 183. The lock cylinder 179 is so arranged on the coin lock 19 that its locking bit 184 is located below the pawl 128. This makes the following manner of operation possible:

FIG. 32 shows the open position of the lock cylinder 179, in which the key 187 (see FIG. 36) can be inserted into it or have been pulled out of it. The flattening 185 of the locking bit 184 extends at a distance from the pawl 128 of the coin lock 19. In this position the stop pin 156 rests against the head of the lower threaded screw 183. If the key 187 is now introduced into the key channel 182 and turned in such a manner that, due to the resultant carrying along of the locking bit 184, the stop pin 186 comes against the head of the upper threaded screw 183, then the flattening 185 of the locking bit 184 is displaced. In this position, the cylindrical wall surface 188 of the locking bit 184 comes against the bottom of the pawl 128, whereby the latter is turned around the support pin 127 and raised. The locking tooth 130 of the pawl 128 assumes a position in which it can no longer come against the locking shoulder 170 of the recess 131 of the locking slide 123 upon a displacement of the locking slide 123 in the direction opposite the direction of the arrow 159. In this advanced position of the lock cylinder 179, the locking slide 123, which forms a locking member 123', of the coin lock 19 is released.

The lock cylinder 179 has means which prevent its key 187 from being removed in the advanced position. A removal of the key 187 is possible only in the open position.

As has been described above, in addition to an actuation of the coin lock 19 by the insertion of a coin 145, displacement of the locking slide 123 in the direction opposite the direction of the arrow 159 is also possible if the lock cylinder 179 is brought into its advanced position, in which the pawl 128 is raised by the locking bit 184. The locking slide can therefore be displaced either by coin operation or else by actuation of the lock cylinder 179. However, displacement is also possible if both measures were carried out, which, however, is somewhat remote from actual practice. It is evident from the above that the object of the invention thus requires, in each case, the insertion of a coin for the advancing of the permutation lock 5 or else requires possession of the key 187 for the lock cylinder 179, in which connection the combination of the permutation lock 5 is stored upon the advancing.

Figure 39:
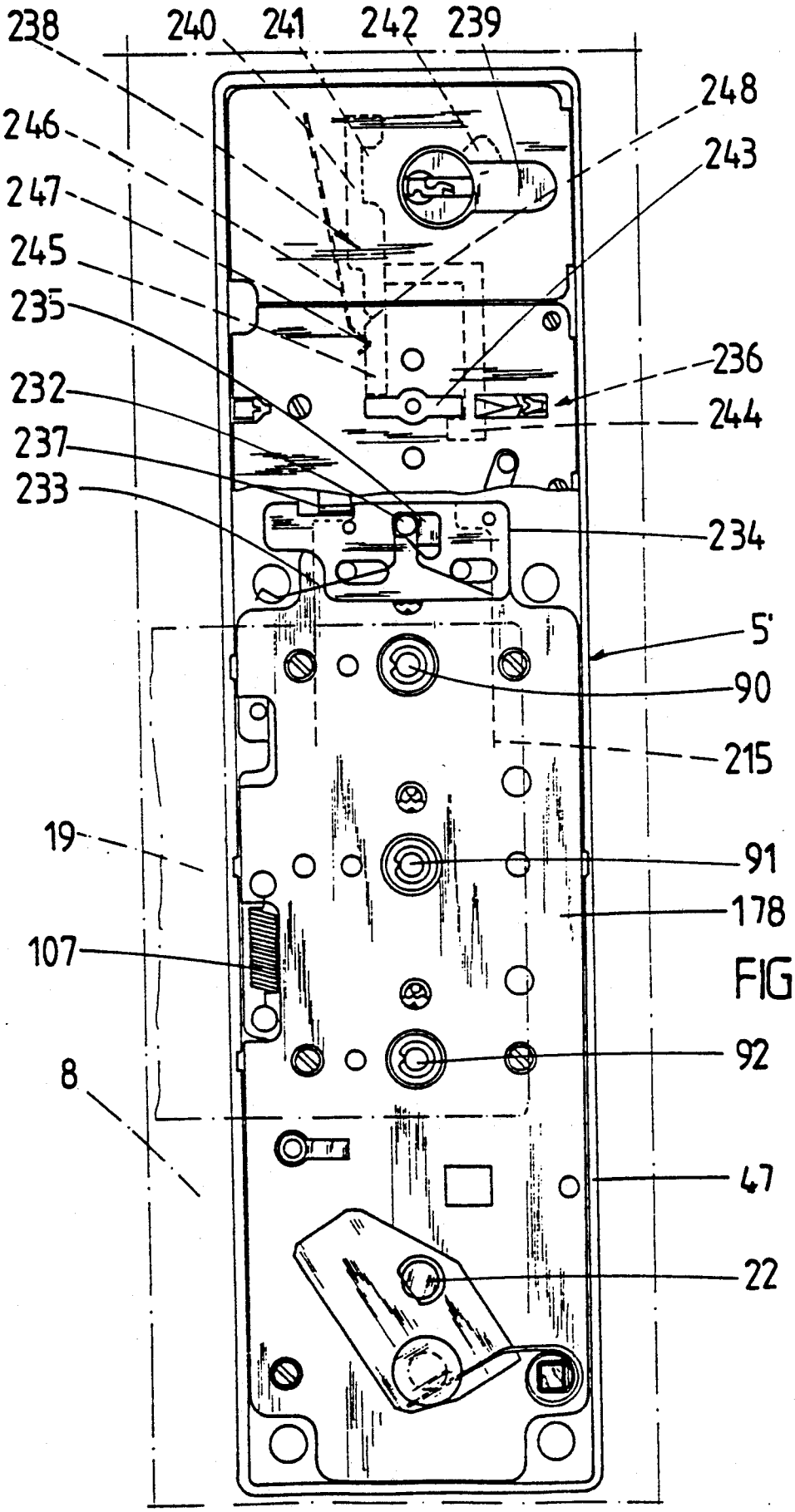
FIG. 39 is a view in the direction of the lock cover of a differently developed permutation lock, with the emergency opening mechanism brought out of engagement.
Figure 41:
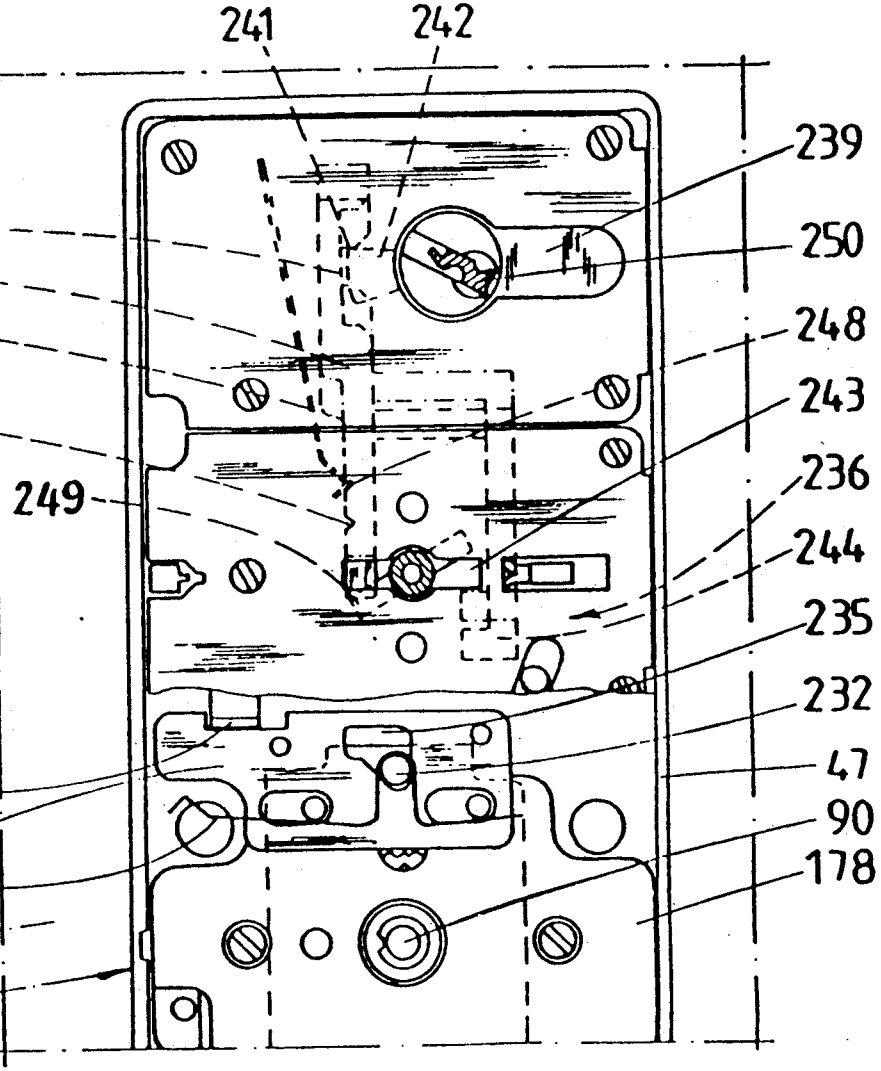
FIG. 41 is a view corresponding to FIG. 40, the reactivation key being inserted into the additional lock and turned with return of the blocking slide with release of the emergency key.
Figure 40:
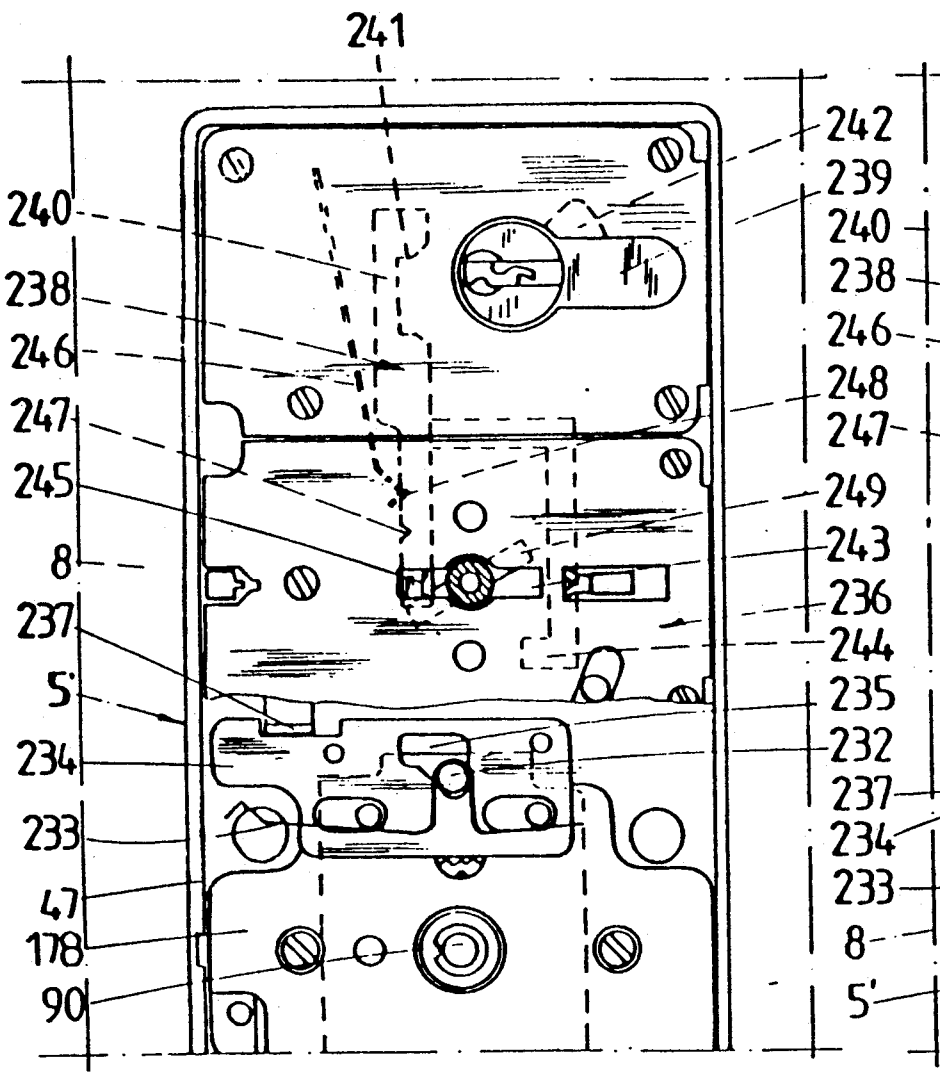
FIG. 40 is a partial view of the permutation lock, the slide of the emergency opening mechanism being released in the direction of its active position due to the inserted and turned emergency key.

FIGS. 39 to 41 show a modified embodiment of the permutation lock 5'. Its construction corresponds substantially to the permutation lock described above. In contradistinction to the latter, the slide 215 differs by the fact that it does not form a lug which cooperates with a leaf spring and blocking pin.

At its rear end, the slide 215 bears a driver pin 232. A leg spring 233 is wrapped around the driver pin and urges the slide 215 in the direction of the bolt head 53. The displacement is, however, limited by a transverse slide 234 guided on the side of the lock housing, the driver pin 332 extending into the recess 235 of the transverse slide 234. Recess 235 is of approximately triangular shape in the manner that the driver pin 332 is located at the upper vertex of the triangle when the slide is retracted, as shown in FIG. 39.

The transverse slide 234 can be displaced by means of a following tumbler lock 236, not shown in detail. By means of the latter, a bolt member 237 can be displaced transverse to the longitudinal direction of the permutation lock 5' while carrying along the transverse slide 234. A capture device 238 is arranged behind the tumbler lock 236. The capture device comprises an additional lock 239 developed as lock cylinder and a blocking slide 240. The latter is provided with an engagement opening 241 for the locking bit 242 of the additional lock 239. The blocking slide 241 is provided with a hook 244 which grips around the lower end of the keyhole 243. The blocking slide 240 has, opposite said hook 244, a blocking tongue 245 which, when the blocking slide 240 is retracted, terminates just in front of the upper end of the keyhole 243, see FIG. 39. Self-displacement of the blocking slide 240 is prevented by detent spring 246 which cooperates with detent notches 247, 248 of the blocking slide 240.

If the user of the safe in accordance with this embodiment of the permutation lock 5' has forgotten his combination, then an authorized person can insert the emergency key 249, developed as double-bit key, into the keyhole 243. After a partial turning of the emergency key 249 in clockwise direction, the bolt member 237 is displaced transversely while carrying along the transverse slide 234, so that the driver pin 232 passes into the opposite region of the recess 235. As a result, the leg spring 233 can enter into action and displace the slide 215 in the direction of the bolt head 53. The setting knobs 7 can then be turned into the corresponding position, so that the bolt 51 can then be retracted by means of the actuating handle 6. However, as an indication of the opening, the emergency key 249 remains in the keyhole. It cannot be pulled out since, upon the turning of the emergency key, the blocking slide 238 was moved via the hook 244 into the position shown in FIG. 40. The tongue 245 thus lies against an obstacle in the removal path of the emergency key 249.

For returning the emergency opening mechanism into its starting position, the authorized person of the hotel, etc., must insert the reactivation key 250 into the lock cylinder 239 and turn the locking bit 242, with return of the blocking slide 240 from its position shown in FIG. 40 into the position shown in FIG. 41, with simultaneous releasing of the keyhole 243. After completion of the locking turn, the reactivation key 250 and the emergency key 249 can be removed.

Instead of the showing contained in the drawing, the locking cylinder 239 for the reactivation key 250 can also be arranged on the inside of the door.

Figure 43:
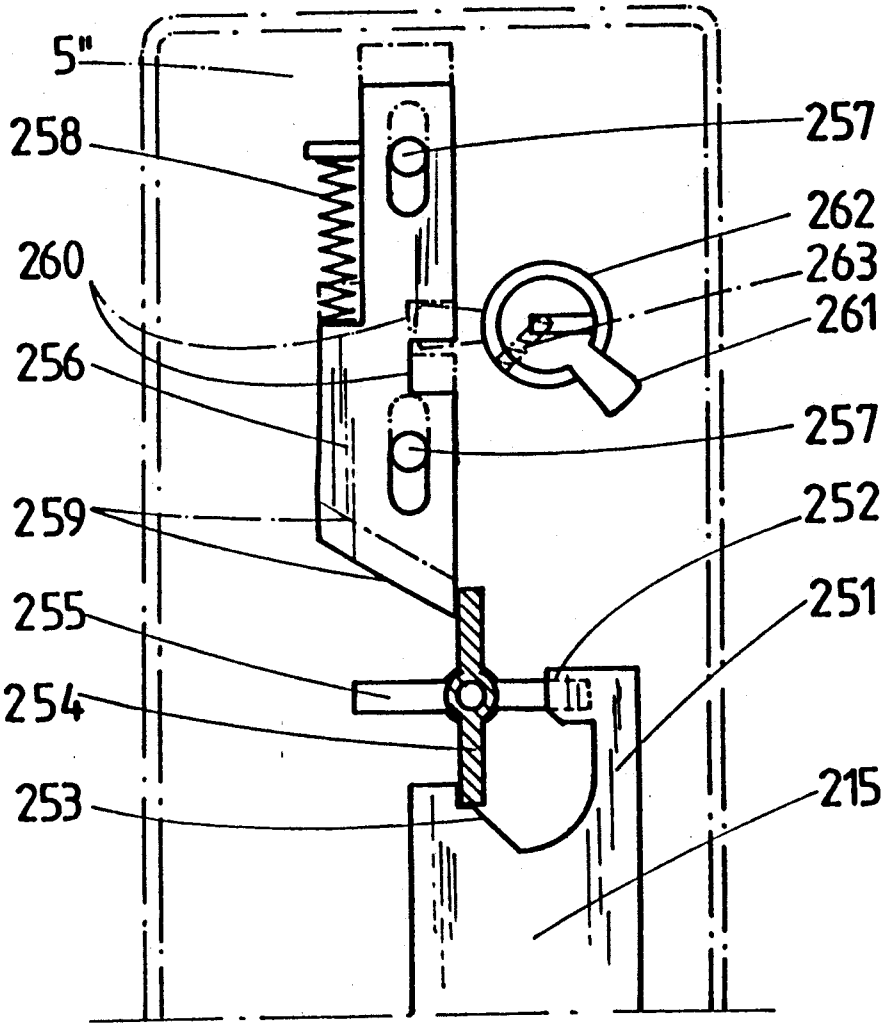
FIG. 43 is a showing similar to FIG. 42, in which the pawl has been moved back from the corresponding lock cylinder-locking member by means of the reactivation key in order to release the emergency key.
Figure 42:
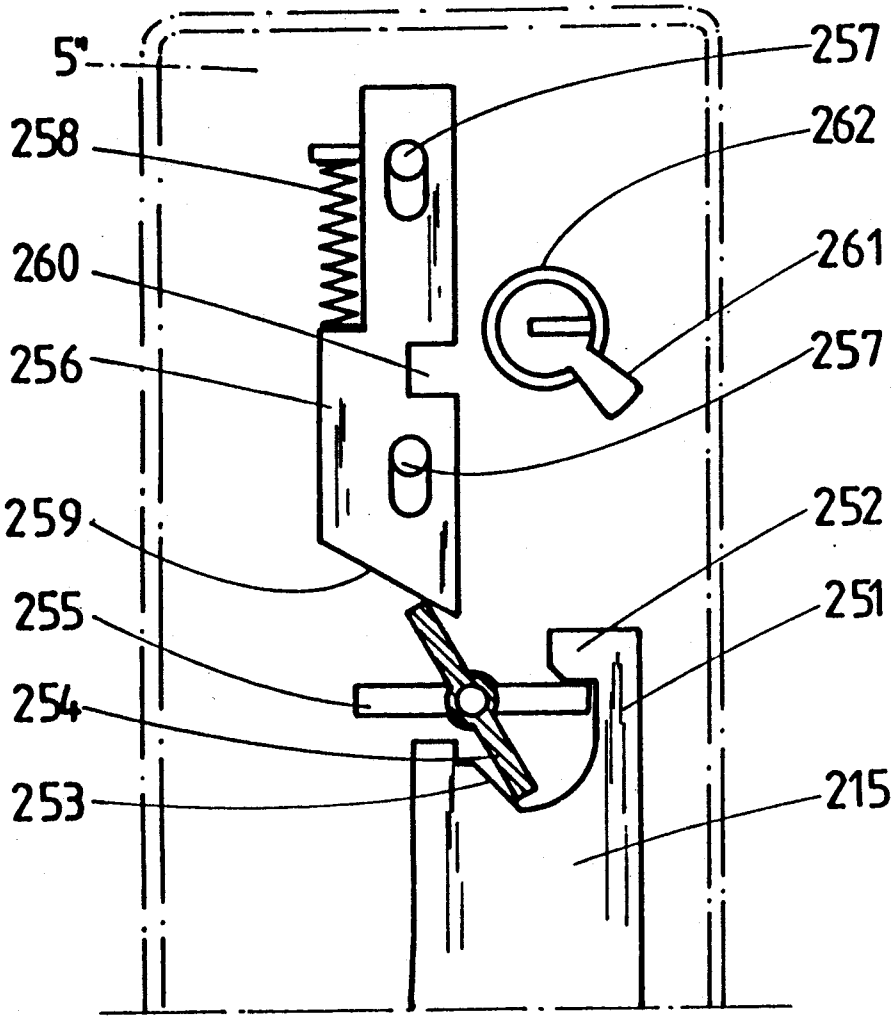
FIG. 42 is a development similar to the preceding embodiment, the emergency key being blocked in its active position against turning backward by a pawl.

FIGS. 42 and 43 show another variant of the permutation lock 5''. As emergency key 254 there is again used a bit key. It acts directly on the facing end 251 of the blocking slide 215, which is secured in its inactive position by Chubb tumblers, not shown. The end 251 of the blocking slide 215 forms a nose 252 as well as a control bevel 253. The emergency key 254 is also a double-bit key which must be inserted into a correspondingly shaped keyhole 255.

A pawl 256, which is developed as a slide, is arranged behind the keyhole 255, the pawl being guided on two support pins 257 of the lock housing. A compression spring 258 which rests against the housing side, urges the pawl 256 in the direction of the key hole. On its flank facing the key hole, the pawl forms a run-on bevel 259 for the emergency key 254.

On its flank opposite the compression spring 258, the pawl 256 is provided with an engagement opening 260 for the locking bit 261 of a lock cylinder 262.

In this variant, the emergency opening mechanism is operated in the manner that, in the event of loss of the combination, the emergency key 254 is introduced into the keyhole 255. The emergency key 254 must now be turned 90° in clockwise direction. Via the control bevel 253, the advancing of the slide 215 takes place into the position which makes it possible to set the combination in the manner described above. After a turn of 90°, however, the key 254 is captured due to the fact that the pawl 256 has placed itself, after a yielding movement, in front of the corresponding key bit region, see FIG. 43. The turning back and removal of the emergency key is then impossible. The captured key thus remains as indication that the safe has been opened. The emergency key 254 can only be removed by using the reactivation key 263. By means of this reactivation key and via the locking bit 261, the pawl 256 can be moved back into the position shown in dash-dot line in FIG. 43, which makes the subsequent turning back of the emergency key 254 into the removal position possible. After turning back the locking bit 261, the reactivation key 263 can then also be removed.

A further embodiment could be developed in the following manner:

If the locking slide 123 is extended to form a true bolt which then takes over the locking function of the superfluous bolt 51, and if this bolt is locked by the locking member 205 of the lock cylinder 201 which is to be removed, then the necessity to find the combination again is no longer present, provided that the emergency key disengages this bolt from the permutation lock and the reactivation key connects the bolt again to the permutation lock, while taking over the combination which the lock has at that moment as new combination.

Instead of the variants described above, one can also use a pure permutation lock variant, for instance on basis of an electronic permutation lock, for instance a push-button lock. For normal locking, the hotel guest, for instance, enters a certain combination. This combination is stored by separate pressing of the buttons or by manually advancing the bolts. In case of storage by pressing the buttons, the bolt can also advance electrically. Usually the guest can repeatedly open his safe by reusing this normal lock combination and close it again with the same combination or with some other combination.

In addition there is then also a key actuation for an emergency opening, i.e. a different combination is entered which overrides the use combination. With this combination the emergency opening is then activated. The safe bolt is retracted electrically or it can be turned back by hand. This emergency opening condition can, however, only be eliminated again, i.e. the corresponding emergency opening mechanism can be deactivated again, only if a different reactivation code is entered. Only by using this reactivation code can the normal starting position, permitting use by the hotel guest, be brought about again.

To this extent, this embodiment also retains the entire basic principle that it can readily be assured that after establishing the emergency opening condition another person (who knows the reactivation code) must always be called in and that, accordingly, the person who has brought about the emergency opening condition is not able to bring the safe into its normal condition of use without leaving traces. The establishing of the emergency opening condition need not necessarily reside in the retracting of the bolt; it can also take place by using a corresponding, for instance an electrically controlled, strike plate similar to a dooropener striking plate. The emergency open code moves this strike plate into the opening position. However, it can only be brought back again into its striking plate operating position by the reactivation key/reactivation code.

In the case of storage compartments having a coin lock on the inner side of the door, then, together with the moving of the lock into the emergency opening position (by the emergency opening code), the coin-insertion slot present there can also be closed by a slide or the like. The storage compartment can then no longer be closed in normal manner due to the impossibility of inserting the coin required for this. The coin slot is opened again only after entering a reactivation code, so that the normal readiness for use by hotel guests or the like is only on present again from this point.

I claim:

1. A permutation lock suitable for storage compartments and operating with a variable combination, comprising a bolt and an emergency opening mechanism; and wherein an opening combination corresponds to a combination to which the lock is set by advancement of the bolt into a locked position;

said emergency opening mechanism is activated by use of an emergency key; and the emergency opening mechanism is deactivatable only by means of a reactivation key.

2. A permutation lock according to claim 1, wherein the emergency opening mechanism comprises ratchet disks and a slide, the slide being displaceable by the emergency key; and said slide passes into a combination-stop position of the ratchet disks, and is movable back into a release position by means of the reactivation key.

3. A permutation lock according to claim 1, wherein said emergency opening mechanism comprises a lock cylinder with a mount; and said lock cylinder of the emergency opening mechanism is removable from said mount by means of the emergency key.

4. A permutation lock according to claim 3, wherein the lock cylinder has a locking member;

the emergency opening mechanism comprises a slide; and the emergency key can be turned by only a limited angle of rotation over which the locking member of the lock cylinder cannot be coupled to the slide, the slide being displaceable into the combination position.

5. A permutation lock according to claim 3, wherein the lock cylinder comprises a detent; and the emergency key releases the detent of the lock cylinder to the mount.

6. A permutation lock according to claim 1, wherein said emergency opening mechanism comprises a lock cylinder and a slide;

the slide is spring loaded in a direction opposite the lock cylinder and has a control projection which faces the lock cylinder; and the slide is provided with a latch bevel;

the lock cylinder comprises a locking member; and the control projection extends in an advanced position of the slide, into an insertion path of the locking member.

7. A permutation lock according to claim 1, wherein said emergency opening mechanism upon activation thereof prevents prevents a passing into a locked position.

8. A permutation lock according to claim 2, wherein the ratchet disks are blocked against turning when the emergency opening mechanism is active.

9. A permutation lock according to claim 1, further comprising a bolt; and wherein an advancing of the bolt of the permutation lock is blocked upon activation of the emergency opening mechanism.

10. A permutation lock according to claim 1, further comprising a housing, a bolt, a leaf spring, and a blocking pin which connects the spring to the bolt; and wherein said emergency opening mechanism comprises a lock cylinder and a slide;

the slide has a control projection and, at an end of the slide opposite the control projection the slide has a lug which extends obliquely to the direction of the slide and which, when the slide is advanced and the bolt retracted, acts on the leaf spring; and a blocking shoulder on the lock housing side of the bolt opposite the spring, the blocking pin moving in front of the blocking shoulder.

11. A permutation lock according to claim 10, wherein the bolt has a guide bore; and the blocking pin extends through the guide bore of the bolt.

12. A permutation lock according to claim 1, wherein said emergency opening mechanism comprises a capture device;

the emergency opening mechanism captures the emergency key by means of the capture device; and the capture device is brought into the release position by means of the reactivation key.

13. A permutation lock according to claim 12, wherein the emergency key is blocked in a captured active position of the emergency key against turning backward.

14. A permutation lock according to claim 12, further comprising an additional lock; and wherein the capture device has a blocking slide controllable by the reactivation key of the additional lock; and in a position carried along by the emergency key, the additional lock moves in front of the key-insertion opening.

15. A permutation lock according to claim 1, further comprising an additional lock and a pawl; and wherein the pawl captures the emergency key in its active position, and is brought into a release position by means of the additional lock; and the pawl is actuatable by the reactivation key.

16. A permutation lock according to claim 1, wherein the permutation lock is operative to provide the emergency opening key actuation in response to an entering of an override code into the permutation lock; and the permutation lock is operative to provide the reactivation key in response to a reactivation code differing from the actuation code.

* * * * *